US006821695B2

(12) United States Patent
Matsushima et al.

(10) Patent No.: US 6,821,695 B2
(45) Date of Patent: Nov. 23, 2004

(54) ELECTROSTATIC LATENT IMAGE DEVELOPING TONER AND PRODUCTION METHOD THEREOF

(75) Inventors: Asao Matsushima, Hachioji (JP); Ken Ohmura, Hachioji (JP); Takao Yamanouchi, Hachioji (JP); Naohiro Hirose, Hachioji (JP); Tomoe Kitani, Hachioji (JP); Yoshiki Nishimori, Hachioji (JP)

(73) Assignee: Konica Corporation (JP)

( * ) Notice: Subject to any disclaimer, the term of this patent is extended or adjusted under 35 U.S.C. 154(b) by 19 days.

(21) Appl. No.: 10/224,615

(22) Filed: Aug. 20, 2002

(65) Prior Publication Data

US 2003/0113647 A1 Jun. 19, 2003

(30) Foreign Application Priority Data

Aug. 27, 2001 (JP) ..... 2001-256041
Aug. 28, 2001 (JP) ..... 2001-257729

(51) Int. Cl.[7] ..... G03G 9/08
(52) U.S. Cl. ..... 430/108.1; 430/137.14
(58) Field of Search ..... 430/108.1, 137.14

(56) References Cited

U.S. PATENT DOCUMENTS

2003/0129519 A1 * 7/2003 Ishibashi et al. ..... 430/137.14

FOREIGN PATENT DOCUMENTS

| | | |
|---|---|---|
| JP | 06095228 | 4/1994 |
| JP | 07101320 | 11/1995 |
| JP | 11311877 | 11/1999 |

* cited by examiner

*Primary Examiner*—Mark A. Chapman
(74) *Attorney, Agent, or Firm*—Muserlian, Lucas and Mercanti

(57) ABSTRACT

A toner for forming an electrophotographic image is disclosed. The toner particle contains at least two inorganic salts including an inorganic salt comprising a positive ion having a first valence and an inorganic salt comprising a positive ion having a second valence different from the first valence, a total amount of the inorganic salt having the first valence is greatest among the inorganic salts in the toner particle, and a total amount of the inorganic salt having the second valence is second greatest among the inorganic salts in the toner particle.

22 Claims, 3 Drawing Sheets

ELECTROSTATIC LATENT IMAGE DEVELOPING TONER AND PRODUCTION METHOD THEREOF

FIELD OF THE INVENTION

The present invention relates to an electrostatic latent image developing toner (hereinafter occasionally referred simply to as a toner), a developer, and an image forming method which are used in copier and printers.

BACKGROUND OF THE INVENTION

In recent years, in almost all cases, high speed digital copiers, as well as laser printers, form images employing an electrostatic latent image developing system. In this field, in order to meet demands for achieving high image quality, toner comprised of particles having a small diameter, has received increasing attention. Further, in order to obtain the currently desired high quality images, polymerization toner has increasingly received attention as said electrostatic latent image developing toner.

Of polymerization toners, specifically, an emulsion aggregation type polymerization toner, which exhibits a narrow electrostatic charge amount distribution and makes it possible to obtain high resolution images, has received attention. Said emulsion aggregation type toner exhibits advantages in which it is possible to produce, without an increase in cost, toner comprised of particles having a small diameter which has a narrower size distribution than conventional particles. However, in order to introduce said toner onto the market, a way has been needed to enhance the control accuracy of the production process so that the toner particle diameter can be controlled as desired, while further decreasing the constituent toner particle diameter.

However, since said toner comprised of particles having a small diameter, when melted and deformed, exhibits less contact area as well as less adhesion force with recording materials or also called an image support which bears the final image, problems have occurred in which toner offsetting on the fixing member tends to occur. As a means to overcome said problems, when the molecular weight is adjusted so as to decrease the melt viscosity of said toner, problems have occurred in which the glass transition point of the resultant toner decreases, resulting in degradation of the storage stability of said toner.

Japanese Patent Publication Nos. 6-95228 and 7-101320 describe techniques which make said offsetting and said storage stability compatible with each other. In said techniques, toner resins are subjected to metal crosslinking. However, when applied to said toner comprised of particles having a small diameter, desired improvement of the resultant characteristics have not been achieved due to insufficient dispersion of inorganic salts.

On the other hand, Japanese Patent Publication Open to Public Inspection No. 11-311877 describes a technique which stabilizes toner charging characteristics as well as fixing characteristics such as a fixability temperature range. In said techniques, surface active agents as well as water-soluble inorganic salts are incorporated in said toner. However, it was found that said techniques did not result in charging characteristics or in fixing characteristics desired for said toner comprised of particles having a small diameter.

Further, since said toner comprised of particles, having a small diameter, has a relatively high electrostatic charge amount per unit weight, it is required to minimize variation of the electrostatic charge amount due to differences in humidity, as well as due to differences in printing modes such as a continuous mode or an intermittent mode. In order to meet said requirements, techniques have been employed in which charge control agents are used. However, the desired minimization has not been sufficiently achieved.

SUMMARY OF THE INVENTION

An objective of the present invention is to provide an electrostatic latent image developing toner, which exhibits excellent storage stability, minimizes variation of electrostatic charge amount due to high humidity, resulting in consistent production of high quality images while minimizing the variation of developed density, and a developer, as well as an image forming method using the same.

A production method of an electrostatic latent image developing toner is provided which is capable of controlling the toner particle diameter at high accuracy, and results in a narrow particle size distribution as well as a narrow electrostatic charge distribution. Further, an electrostatic latent image developing toner is provided in which variation of the electrostatic charge amount (an electric charge amount), due to differences in humidity as well as printing modes, is minimized.

The invention and preferred embodiments will now be described.

A toner for forming an electrophotographic image comprising a toner particle, wherein the toner particle comprises at least two inorganic salts having different valences. When "a" (in percent) represents the ratio of the first inorganic salt contained in the greatest amount with respect to the total toner weight and "b" (in percent) represents the ratio of the second inorganic salt contained in the second greatest amount, the relationship described below is satisfied.

$$2.0 \geqq a \geqq 0.1$$

$$1.0 \geqq b \geqq 0.01$$

$$7.5 \geqq a/b \geqq 1.1$$

wherein the weight of "a" and "b" is the value in terms of anhydride.

A toner resin comprises polymerizable monomer having a carboxyl group in an amount of 1.0 to 12.0 percent, being the monomer weight ratio, as a recurring unit. The valence difference between the inorganic salt incorporated in toner in the greatest amount, and the inorganic salt incorporated in said toner in the second greatest amount is from 1 to 2.

Both the inorganic salt, incorporated in said toner in the greatest amount, and the inorganic salt, incorporated in the same toner in the second greatest amount, are chlorides.

The glass transition point of said toner is from 50 to 65° C. during the first temperature increasing process and from 40 to 55° C. during the second temperature increasing process.

Toner is prepared by aggregating resin particles and fusing those in a water based medium.

Toner comprises a crystalline organic compound and is prepared in such a manner that, after dissolving said crystalline organic compound, composite resinous particles prepared via the process which polymerizes said polymerizable monomers and colorant particles are salted out/fused.

Said toner is subsequently blended with a carrier and is then employed as a developer.

Said toner can be employed in an image forming method which converts an electrostatic latent image formed on a photoreceptor into a visible image, transfers said visible image onto a recording material, and thermally fixes the resultant image.

In such a process, an electrostatic latent image is preferably formed on the photoreceptor employing digital exposure.

In a production method of electrostatic latent image developing toner, in which toner particles are formed through salting-out/aggregating resinous particles in a dispersion comprising at least resinous particles, a production method of electrostatic latent image developing toner which comprises at least (1) a process for adding a salting-out agent which initiates growth of particles utilizing salting-out/aggregation (a salting-out/aggregating process), (2) a process for adding a salting-out termination agent when the particles reaches predetermined size (a particle growth terminating process), (3) a process for separating particles from said dispersion, and finally (4) a drying process.

The preferable volume average particle diameter of the particles (predetermined size) is 2–9 $\mu$m.

Salting-out termination salts are salts having lower valence of those metal ions or positive ions than those of salting-out agents.

A dispersion comprises an anionic surface active agent, and the valence of metal ions or positive ions of a salting-out agent is to be divalent, and the valence of metal ions or positive ions of a salting-out termination agent is to be monovalent.

A dispersion comprises an anionic surface active agent, and the valence of metal ions or positive ions of a salting-out agent is to be trivalent and the valence of metal ions or positive ions of a salting-out termination agent is to be divalent or monovalent.

With regard to the volume average particle diameter after the drying process, when the particle diameter during the salting-out/aggregation process reaches 80 to 120 percent of the volume average diameter, a salting-out termination agent is added.

DETAILED DESCRIPTION OF THE INVENTION

Figure 1:
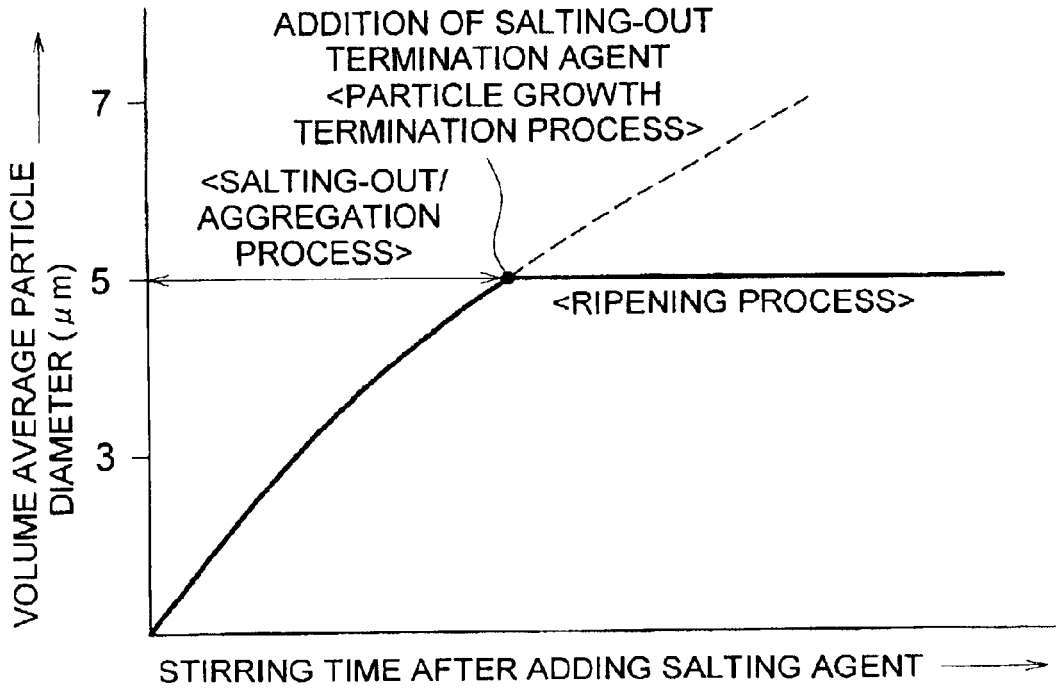
FIG. 1 is a view explaining particle growth as well as particle growth termination.

The toner contains toner particles (colored particles) and so-called external additives such as a fluidizer. The toner particles according to the invention comprise a resin, a colorant and at least two inorganic salts. While the function of said inorganic salts is not yet completely understood, it is assumed that upon incorporating inorganic salts having different valences in a definite amount, charge generation as well as charge transfer is stabilized so that excessive charging of said toner can be retarded and further, metal crosslinking efficiently progresses in the toner resin.

With regard to inorganic salts in the present invention, which have different valances, it is preferable that "a" satisfies the relationship of $1.5 \geqq a \geqq 0.4$, while "b" satisfies the relationship of $0.80 \geqq b \geqq 0.06$, and a/b satisfies the relationship of $7.5 \geqq a/b \geqq 1.1$. By allowing "a", "b", and "a/b" to satisfy the above relationship, it tends to make storage stability of toner and excellent fixability compatible with each other.

Further, by so doing, it is assumed that at normal temperature, namely in the temperature range in which toner is stored, a net structure formed through metal crosslinking between higher valence metal ions and the resin is maintained, while in the fixing temperature range, lower valence metal ions break the crosslinking structure formed by higher valence metal ions so as to decrease the resulting melt viscosity. Therefore, a plurality of inorganic salts having different valences is employed. The resin employed for the toner particle is preferably composed of monomer containing carboxylic acid to form a cross-linking structure between the inorganic ion and the carboxylic acid in the resin.

The valence of an inorganic salt, incorporated in any toner, refers to the valence of the metal element constituting said salt. Further, concentration "a" or "b" of said inorganic salt is to be concentration in terms of its anhydride.

The content of said inorganic salts in toner can be obtained by determining the fluorescent X-ray intensity emitted from the metal element (for example, calcium in calcium chloride), as well as the fluorescent X-ray intensity of the corresponding base, employing a fluorescent X-ray spectrometer "System 3270 Type" (manufactured by Rigaku Denki Kogyo Co.).

One specific measurement method is as follows. A plurality of toners, of which content ratio of an inorganic salt is previously known, is prepared, and 5 g of each toner is pelletized. Subsequently, employing the resultant pellets, the relationship (in the form of a calibration curve) between the content ratio ("a" and "b") of said inorganic salt and the fluorescent X-ray intensity (being the peak intensity), emitted from said inorganic salt, is determined. Thereafter, toner (being a sample), of which content ratio of an inorganic salt is to be determined, is pelletized in the same manner as above and the fluorescent X-ray intensify emitted from said inorganic salt is determined, whereby it is possible to obtain a content ratio, namely "the amount of said inorganic salt in said toner".

It is preferable that the toner of the present invention be prepared by aggregating and fusing at least resinous particles in a water based solvent. The toner, prepared as above, results in uniform distribution of said inorganic salt among all portions of toner particles as well as in the interior of said toner particle, and thereby, the effects of the present invention are consistently exhibited.

In the present invention, the proportion of polymerizable monomers, having a carboxylic group, in the resin is commonly from 1 to 12 percent, is preferably from 3 to 12 percent, and is more preferably from 6 to 10 percent. When said proportion is less than 1 percent, the effects of incorporation of said monomers tends to not be exhibited due to a decrease in metal crosslinking. On the other hand, when said proportion exceeds 12 percent, the resultant toner tends to adsorb moisture, whereby the variation of the charge amount due to humidity tends to increase.

Listed as specific examples of polymerizable monomers, having a carboxylic group, are methacrylic acid and acrylic acid.

Further, in order to allow retention properties and fixability to be compatible with each other, it is preferable to adjust the concentration of metal crosslinking upon selecting the combination of metal ions as well as the added amount, so that the glass transition point of said toner is from 50 to 65° C. during the first temperature increasing process, and from 40 to 55° C. during the second temperature increasing process.

The reasoning for this is as follows. The glass transition point during the first temperature increasing process corresponds to the state in which metal crosslinking has been achieved. Accordingly, by adjusting the glass transition point within said range, it is possible to maintain the retention properties of the toner at the desired level. Further, the glass transition point during the second temperature increasing process corresponds to the state in which the metal crosslinking structure is broken, or namely corresponds to fusing the characteristics during thermal fixing. Therefore, by adjusting the glass transition point within said range, it is possible to obtain the desired fixation strength.

The glass transition point during the first and second temperature increasing processes is determined employing a differential scanning colorimeter (DSC). Listed as a specific apparatus may be DSC-7, manufactured by Perkin-Elmer Corp.

Temperature increasing and decreasing conditions are as follows. After setting aside a sample at 0° C. for one minute, said sample is heated to 200° C. at a rate of 10° C./minute (the first temperature increasing process). Subsequently, after setting aside said sample at 200° C. for one minute, the temperature is decreased to 0° C. at a rate of 10° C./minute (the first temperature decreasing process). Further, after setting aside said sample at 0° C. for one minute, the temperature is increased to 200° C. at a rate of 10° C./minute (the second temperature increasing process).

Said glass transition point is determined as an on set temperature in each temperature increasing process.

Difference in the valences between the inorganic salt incorporated in said toner in the greatest amount and the inorganic salt incorporated in said toner in the second greatest amount is preferably from 1 to 2. Further, from the viewpoint of efficiently generating metal ions, as well as of stabilizing the electric charge of said toner, both the inorganic salt incorporated in said toner in the greatest amount and the inorganic salt incorporated in said toner in the second greatest amount are preferably chlorides.

Methods for adding inorganic salts are not particularly restricted. However, it is preferable that resinous particles are salted out/aggregated, employing a dispersion of resinous particles prepared in a water-based medium, and during the fusing process, di- to tetra-valent inorganic salts are employed as a salting-out agent, and further, inorganic salts, having a lower valence than said salting-out agents, are employed as a salting-out termination agent. Preferred means to control the concentration of inorganic salts in said toner are as follows. Inorganic salts are sealed in said toner particles by varying the added amount of said inorganic salts, by varying the pH during addition, and also by varying the temperature during addition/after addition, and subsequently, said salts on the surface of said particles are optimally removed while varying the amount of washing water.

Further, toner is preferably produced at a temperature of less than or equal to 100° C. By so doing, it is possible to proceed with metal crosslinking, employing higher valent inorganic salts, as well as to weaken the metal crosslinking structure employing lower valent metal ions in a fixing temperature range of more than or equal to 120° C.

Components, elements, and applied techniques according to the present invention will now be described.

1. Kinds of Inorganic Salts

In order to efficiently carry out metal crosslinking, it is preferable that said inorganic salts be inorganic metal salts.

Specific examples of said inorganic salts are shown below.

Employed as monovalent inorganic salts may be sodium chloride, potassium chloride, and lithium chloride. Other than inorganic salts, employed may be ammonium salts such as ammonium chloride.

Listed as divalent inorganic salts are magnesium chloride, calcium chloride, zinc chloride, copper sulfate, magnesium sulfate, and manganese sulfate, and listed as trivalent inorganic salts are aluminum chloride, aluminum hydroxide, aluminum sulfate, and iron chloride. Listed as tetravalent inorganic salts are titanyl sulfate and tin tetrachloride.

In order to enhance the effects of the present invention, preferably employed as inorganic salts incorporated in said toner in the greatest amount are divalent inorganic salts and as the inorganic salts incorporated in said toner in the second greatest amount are monovalent inorganic salts.

It is preferable that the salting-out agents, described below, be incorporated as an inorganic salt in the greatest amount and salting-out termination agents be incorporated as an inorganic solvent in the second greatest amount.

Anionic surface active agents are preferably incorporated in the water based medium in which resinous particles grow through coalescence (i.e., salting-out/fusion). Anionic surface active agents, nonionic surface active agents, and cationic surface active agents may be employed in combination, but incorporating said anionic surface active agents stabilizes toner electric charge. Said anionic surface active agents may be incorporated in a resinous particle dispersion and brought into said water based media or may be newly added to said water based media during coalescence.

2. Production Method of Toner

The production method of the toner of the present invention will now be described.

Production methods of the toner of the present invention are not particularly limited, but it is possible employ various methods such as a pulverization method in which resins, colorants, the metal salts according to the invention and other additives are kneaded, pulverized, and classified. However, it is preferable that said toner be prepared employing a so-called polymerization method in which at least polymerizable monomers are polymerized in a water based medium.

Suspension Polymerization

When the toner is produced by the suspension polymerization method, the production is performed by the following procedure. Various raw materials such as a colorant, a mold releasing agent according to necessity, a charge controlling agent and a polymerization initiator are added into a polymerizable monomer and dispersed or dissolved by a homogenizer, a sand mill, a sand grinder or a ultrasonic dispersing apparatus. The polymerizable monomer in which the raw materials are dissolved or dispersed is dispersed into a form of oil drops having a suitable size as toner particle by a homo-mixer or a homogenizer in an aqueous medium containing a dispersion stabilizing agent. Then the dispersion is moved into a reaction vessel having a stirring device with double stirring blades, and the polymerization reaction is progressed by heating. After finish of the reaction, the dispersion stabilizing agent is removed from the polymer particles and the polymer particles are filtered, washed and dried to prepare a toner. In the invention, the "aqueous medium" is a medium containing at least 50% by weight of water.

Emulsion Polymerization

The toner according to the invention can be also obtained by salting-out/fusing resinous particles prepared in an aqueous medium.

For example, the methods described in JP O.P.I. Nos. 5-265252, 6-329947 and 9-15904 are applicable. The toner can be produced by a method by which dispersed particles of constituting material such as resinous particles and colorant or fine particles constituted by resin and colorant are associated several by several. Such the method is realized particularly by the following procedure: the particles are dispersed in water and the particles are salted-out by addition of a coagulation agent in an amount of larger than the critical coagulation concentration. At the same time, the particles are gradually grown by melt-adhesion of the particles by heating at a temperature higher than the glass transition point of the produced polymer. The particle growing is stopped by addition of a large amount of water when the particle size is reached at the prescribed diameter. Then the surface of the particle is made smooth by heating and stirring to control the shape of the particles. The particles containing water in a fluid state are dried by heating. Thus the toner can be produced. In the foregoing method, an infinitely water-miscible solvent such as alcohol may be added together with the coagulation agent.

The representative preparation method of the toner is salting-out/fusing the complex resinous fine particles obtained by multi-step polymerization and colorant particles. The multi-step polymerization will be described more in detail below.

Preparation Method of Composite Resinous Particles Obtained by a Multi-step Polymerization The production process comprises, for example, the following processes:

1. A multi-step polymerizing process
2. A salting-out/fusion process to produce toner particles by salting-out/fusing the composite resinous particles and colored particles
3. Filtering and washing processes to filter the toner particles from the toner particle dispersion and to remove a unnecessary substance such as the surfactant from the toner particles
4. A drying process to dry the washed toner particles
5. A process to add an exterior additive to the toner particles Each of the processes is described below.

Multi-step Polymerization Process

The multi-step polymerization process is a process for preparing the composite resinous particle having broader molecular weight distribution so as to obtain enhanced anti-off-set characteristics. A plural of polymerization reaction is conducted in separate steps so that each particle has different layers having different molecular weight. The obtained particle has a gradient of molecular weight from the center to the surface of the particle. For example, a lower molecular weight surface layer is formed by adding a polymerizable monomer and a chain transfer agent after obtaining a higher molecular weight polymer particles dispersion.

It is preferred from the viewpoint of the stability and the anti-crush strength of the obtained toner to apply the multi-step polymerization including three or more polymerization steps. The two- and tree-step polymerization methods, which are representative examples, are described below. It is preferable that the closer to the surface the molecular weight is lower in view of the anti-crush strength.

Two-step Polymerization Method

The two-step polymerization method is a method for producing the composite resinous particle comprised of the central portion (core) comprising the high molecular weight resin and an outer layer (shell) comprising the low molecular weight resin. The central portion (core) may contain a releasing agent or a crystalline material.

In concrete, a monomer liquid is dispersed in an aqueous medium (an aqueous solution of a surfactant) in a form of oil drop, and the system is subjected to a polymerization treatment (the first polymerization step) to prepare a dispersion of a higher molecular weight resinous particles each containing the crystalline material. In case that the core portion contains the releasing agent or crystalline material, these are incorporated in the monomer liquid.

Next, a polymerization initiator and a monomer to form the lower molecular weight resin is added to the suspension of the resin articles, and the monomer is subjected to a polymerization treatment (the second polymerization step) to form a covering layer composed of the lower molecular weight resin (a polymer of the monomer) onto the resinous particle.

Three-step Polymerization Method

The three-step polymerization method is a method for producing the composite resinous particle comprised of the central portion (core) comprising the high molecular weight resin, the inter layer containing the middle molecular weight resin and the outer layer (shell) comprising the low molecular weight resin. The inter layer may contain the releasing agent or crystalline material.

In concrete, a suspension of the resinous particles prepared by the polymerization treatment (the first polymerization step) according to a usual procedure is added to an aqueous medium (an aqueous solution of a surfactant) and a monomer liquid is dispersed in the aqueous medium. The aqueous dispersion system is subjected to a polymerization treatment (the second polymerization step) to form a covering layer (inter layer) comprising a resin (a polymer of the monomer) onto the surface of the resinous particle (core particle). The releasing agent or crystalline material may be incorporated in the monomer liquid. Thus a suspension of combined resin (higher molecular weight resin-middle molecular weight resin) particles is prepared so that the inter layer contains these.

Next, a polymerization initiator and a monomer to form the lower molecular weight resin is added to the dispersion of the combined resinous particles, and the monomer is subjected to a polymerization treatment (the third polymerization step) to form a covering layer composed of the low molecular weight resin (a polymer of the monomer) onto the composite resinous particle.

In the three-step polymerization method, the releasing agent or crystalline material can be finely and uniformly dispersed in case that the releasing agent or crystalline material is incorporated in the monomer liquid for forming the inter layer.

The polymer is obtained by polymerization in the aqueous medium. The monomer liquid is dispersed in the aqueous medium as oil drop at the time of forming resinous particles (core) or covering layer thereon (inter layer), and resinous particles can be obtained as latex particles by polymerization treatment with the addition of initiator.

The water based medium means one in which at least 50 percent, by weight of water, is incorporated.

Herein, components other than water may include water-soluble organic solvents. Listed as examples are methanol, ethanol, isopropanol, butanol, acetone, methyl ethyl ketone, tetrahydrofuran, and the like. Of these, preferred are alcohol based organic solvents such as methanol, ethanol, isopropanol, butanol, and the like which do not dissolve resins.

Methods are preferred in which dispersion is carried out employing mechanical force. Said monomer solution is preferably subjected to oil droplet dispersion (essentially an embodiment in a mini-emulsion method), employing mechanical force, especially into water based medium prepared by dissolving a surface active agent at a concentration of lower than its critical micelle concentration. An oil soluble polymerization initiator may be added to the monomer solution in place of a part or all of water soluble polymerization initiator.

In the usual emulsion polymerization method, the crystalline material dissolved in oil phase tends to desorb. On the other hand sufficient amount of the crystalline material can be incorporated in a resinous particle or covered layer by the mini-emulsion method in which oil droplets are formed mechanically.

Herein, homogenizers to conduct oil droplet dispersion, employing mechanical forces, are not particularly limited, and include, for example, "CLEARMIX" manufactured by M-Technique Co., Ltd., ultrasonic homogenizers, mechanical homogenizers, and Manton-Gaulin homogenizers and pressure type homogenizers.

The diameter of dispersed particles is 10 to 1,000 nm, and is preferably 30 to 300 nm.

Emulsion polymerization, suspension polymerization seed emulsion etc. may be employed as the polymerization method to form resinous particles or covered layer containing the crystalline material. These polymerization methods are also applied to forming resinous particles (core particles) or covered layer which do not contain the crystalline material.

The particle diameter of composite particles obtained by the process (1) is preferably from 10 to 1,000 nm in terms of weight average diameter determined employing an electrophoresis light scattering photometer "ELS-800" (produced by Otsuka Electronics Co., Ltd.).

Glass transition temperature (Tg) of the composite resinous particles is preferably from 40 to 74° C., more preferably from 50 to 65° C., and particularly preferably from 52 to 64° C.

The Softening point of the composite resinous particles is preferably from 95 to 140° C.

<Salting-out/Fusion Process>

Salting-out/fusion process is a process to obtain toner particles having undefined shape (aspherical shape) in which the composite resinous particles obtained by the foregoing process and colored particles are aggregated through salting-out/fusion process, wherein the salting-out and fusion processes are caused simultaneously.

Salting-out/fusion process of the invention is that the processes of salting-out (coagulation of fine particles) and fusion (distinction of surface between the fine particles) occur simultaneously, or the processes of salting-out and fusion are induced simultaneously. Particles (composite resinous particles and colored particles) must be subjected to coagulation in such a temperature condition as lower than the glass transition temperature (Tg) of the resin composing the composite resinous particles so that the processes of salting-out (coagulation of fine particles) and fusion (distinction of surface between the fine particles) occur simultaneously.

Particles of additives incorporated within toner particles such as a charge control agent (particles having average diameter from 10 to 1,000 nm) may be added as well as the composite resinous particles and the colored particles in the salting-out/fusion process. Surface of the colored particles may be modified by a surface modifier.

Further, in the present invention, after preparing colored particles (in the present invention, called toner particles) upon salting out, aggregating, and coalescing resin particles and colorants in a water based medium, separation of said toner particles from said water based medium is preferably carried out at a temperature of not lower than the Krafft point of the surface active agents in said water based medium, and is more preferably carried out in the range of said Krafft point to said Karfft point plus 20° C.

The Krafft point, as described herein, refers to the temperature at which an aqueous solution comprising a surface active agent starts to become milky-white. The Krafft point is measured as follows.

<<Measurement of Krafft Point>>

A solution is prepared by adding a coagulant in a practically employed amount to a water based medium employed in salting-out, aggregation, and coalescence processes, namely a surface active agent solution. The resulting solution is stored at 1° C. for 5 days. Subsequently, the resulting solution is heated while stirring until it becomes transparent. The temperature, at which said solution becomes transparent, is defined as its Krafft point.

Subsequently, specific examples of salting-out agents are described below.

Listed as divalent inorganic salts are magnesium chloride, calcium chloride, zinc chloride, copper sulfate, magnesium sulfate, and manganese sulfate, while listed as trivalent inorganic salts are aluminum chloride, aluminum hydroxide, aluminum sulfate, and iron chloride. Listed as tetravalent inorganic salts are titanyl sulfate and tin tetrachloride.

The inorganic salt is selected according to the purpose optionally. The preferable example is a divalent or trivalent inorganic salt in view of easy control of toner particle size because coagulation proceeds with moderate rate by the divalent or trivalent inorganic salt. The most preferable example is divalent inorganic salt.

In the present invention, the concentration of salting-out agents is commonly more than or equal to the critical aggregation concentration, is preferably at least 1.2 times the critical aggregation concentration, and is more preferably at least 1.5 times.

The critical coagulation concentration is an index of the stability of dispersed materials in an aqueous dispersion, and shows the concentration at which coagulation is initiated. This critical coagulation concentration varies greatly depending on the fine polymer particles as well as dispersing agents, for example, as described in Seizo Okamura, et al, Kobunshi Kagaku (Polymer Chemistry), Vol. 17, page 601 (1960), etc., and the value can be obtained with reference to the above-mentioned publications. Further, as another method, the critical coagulation concentration may be obtained as described below. An appropriate salt is added to a particle dispersion while changing the salt concentration to measure the $\zeta$ potential of the dispersion, and in addition the critical coagulation concentration may be obtained as the salt concentration which initiates a variation in the $\zeta$ potential.

The polymer particles dispersion liquid is processed by employing an inorganic salt so as to have concentration not less than critical coagulation concentration. In this instance the inorganic salt is added directly or in a form of aqueous solution optionally, which is determined according to the purpose. In case that it is added in an aqueous solution the metal salt must satisfy the critical coagulation concentration including the water as the solvent of the inorganic salt.

A part of the salting-out agent is incorporated within the toner particles. Amount of the salting-out agent within the toner particle is adjusted to from 0.1 to 2.0%, preferably from 0.0.4 to 1.5% by weight of the toner. The incorporated amount can be controlled by the amount of addition, rate of aggregation, temperature of the processing liquid, degree of water wash and so on.

Salting-out Termination Agent and Process

A view explaining particle growth as well as particle growth termination are shown by FIG. 1.

By employing said salting-out termination agents, it is possible to quickly terminate particle growth. As a result, it is possible to prepare toner particles having minimal coarse particles, namely having a narrow particle size distribution. Agitation is continued for certain time subsequently and that is called as a digesting process.

When resinous particles reach the target size through the progress of salting-out, salting-out termination agents are preferably added. The salting-out termination agents, as described herein, refer to compounds which exhibit the following functions. When there is a salting-out termination agent together with a salt employed as a salting-out agent (when there are two types of metal ions or non-metal positive ions), aggregation force of resinous particles is lowered compared to the case in which said salting-out agent and said salting-out termination agent are employed individually. Specifically, said salting-out termination agents refers to salts having a different valence of positive ions with respect to said salting-out agent or salts having a different ionic radius even when the valence is the same. However, in the present invention, it is preferable that salts having a lower valance of positive ions than said salting-out agent are used.

Heretofore, without using salting-out termination agents, growth of aggregated particles, which are to be employed as a toner, has been terminated by means such as dilution, employing a large amount of water. However, by employing the salting-out termination agents of the present invention, it is possible to quickly terminate particle growth. As a result, it has become possible to prepare toner having minimal coarse particles, namely toner having a narrow particle size distribution.

The inventors of the present invention discovered that in the salting-out/aggregation process, when there were two types of positive ions as described above, the aggregation rate of resinous particles did not fall in the range between those, but markedly decreased. By applying the discovered phenomena to the growth termination of salting-out/aggregated particles, the present invention was achieved. Though the mechanism is not yet fully understood, it is assumed that the resultant phenomena are due to antagonism between positive ions.

Listed as monovalent inorganic salts, which can be used as a salting-out termination agent, are sodium chloride, potassium chloride and lithium chloride. Other than inorganic metal salts, it is also possible to employ ammonium salts such as ammonium chloride. Employed as divalent and trivalent inorganic salts may be salts analogous to salting-out agents. A part of the salting-out termination agent is incorporated within the toner particles. Amount of the salting-out termination agent within the toner particle is adjusted to from 0.01 to 1.0%, preferably from 0.06 to 0.8% by weight of the toner. The incorporated amount can be controlled by the amount of addition, temperature of the processing liquid, degree of water wash and so on.

Namely, Table 1 below shows examples of preferred combinations of the types of the aforesaid salting-out agents and salting-out termination agents, and the valences thereof.

TABLE 1

| | Salting-out agent | Salting-Out Termination Agent |
|---|---|---|
| Particularly Preferred Embodiments | divalent metal salt | monovalent metal salt |
| Preferred Embodiments | trivalent metal salt | divalent metal salt |
| Other Embodiments | trivalent metal salt | monovalent metal salt |
| | divalent metal salt | monovalent ammonium salt |
| | tetravalent metal salt | trivalent metal salt |
| | tetravalent metal salt | divalent metal salt |
| | tetravalent metal salt | monovalent metal salt |

In the present invention, particle growth, which is continued during the salting-out/aggregation process, is terminated during the particle growth termination process in which the salting-out termination agents are added. However, the particle growth may not be completely terminated but the resultant marked decrease in the growth rate may be acceptable.

Said salting-out termination agents are added when the toner particle diameter reaches 80 to 120 percent of the final toner particle diameter, and are preferably added when the toner particle diameter reaches 90 to 110 percent. Specifically, when, for example, it is desired to prepare toner comprised of particles of a volume average diameter of 5 $\mu$m, it is preferable that said addition be carried out when the diameter of coalesced particles reaches 4 to 6 $\mu$m. It is more preferable that the addition be carried out when said diameter reaches 4.5 to 5.4 $\mu$m.

After adding said salting-out termination agents, slight particle growth continues, or measured particle diameter occasionally decreases due to variation of particle shape due to continued stirring. However, when said salting-out termination agents are added as specified above, repeatability of the desired average particle diameter is obtained.

The volume average particle diameter, as described in the present invention, refers to the diameter determined employing a Coulter Multisizer (manufactured by Coulter Inc.) or FPIA-2000 (manufactured by Sysmex Corp.).

The added amount of salting-out agents as well as salting-out termination agents may be adjusted based on the valance of each agent. Said salting-out agents and salting-out termination agents are preferably added in the form of an aqueous solution. However, they may be added in the form of a powder.

From the viewpoint of minimizing application of excessive charge to toner particles as well as providing uniform chargeability to said toner particles, specifically, in order to stabilize and maintain said chargeability in spite of the environment, the electrostatic latent image developing toner of the present invention comprises the aforesaid inorganic salt (listed as the kind are metals and metal ions), which have been described as the aforesaid salting-out agents and salting-out termination agents, preferably in an amount of 250 to 30,000 ppm in said toner, and more preferably 250 to 20,000 ppm and particularly preferably in an amount of 800 to 15,000 ppm.

Further, the total amount of metal elements employed as said salting-out agents and for example, the monovalent metal element added as said salting-out termination agent is preferably from 350 to 35,000 ppm in terms of a chloride.

Digestion Process

The digestion process is a process following to the salting-out/fusion process, wherein the crystalline material is subjected to phase separation by continuing agitation with constant strength keeping temperature close to the melting point of the crystalline material, preferably plus minus 20 centigrade of the melting point, after the coagulation of fine particles. The shape coefficient and variation coefficient thereof, may be controlled in this process.

The colored particles are subjected to salting out/fusion process in a state that they are dispersed in water based medium. The water based medium to disperse the colored particles includes an aqueous solution dissolving a surfactant in concentration not less than critical micelle concentration (CMC).

Homogenizers employed in the dispersion of the colored particles include, for example, "CLEARMIX" manufactured by M-Technique Co., Ltd., ultrasonic homogenizers, mechanical homogenizers, and Manton-Gaulin homogenizers and pressure type homogenizers.

In order to simultaneously carry out salting-out and fusion, it is required that salting-out agent (coagulant) is added to the dispersion of composite particles and colored particles in an amount not less than critical micelle concentration and they are heated to a temperature of the glass transition temperature (Tg) or higher of the resin constituting composite particles.

Suitable temperature for salting-out/fusion is preferably from (Tg plus 10° C.) to (Tg plus 50° C.), and more preferably from (Tg plus 15° C.) to (Tg plus 40° C.).

An organic solvent which is dissolved in water infinitely may be added in order to conduct the salting-out/fusion effectively.

Filtration and Washing Process

In said filtration and washing process, filtration is carried out in which said toner particles are collected from the toner particle dispersion, and washing is also carried out in which additives such as surface active agents, salting-out agents, and the like, are removed from the collected toner particles (a cake-like aggregate).

Herein, filtering methods are not particularly limited, and include a centrifugal separation method, a vacuum filtration method which is carried out employing Buchner funnel and the like, a filtration method which is carried out employing a filter press, and the like.

Drying Process

This process is one in which said washed toner particles are dried.

Listed as dryers employed in this process may be spray dryers, vacuum freeze dryers, vacuum dryers, and the like. Further, standing tray dryers, movable tray dryers, fluidized-bed layer dryers, rotary dryers, stirring dryers, and the like are preferably employed.

It is proposed that the moisture content of dried toners is preferably not more than 5 percent by weight, and is more preferably not more than 2 percent by weight.

Further, when dried toner particles are aggregated due to weak attractive forces among particles, aggregates may be subjected to crushing treatment. Herein, employed as crushing devices may be mechanical a crushing devices such as a jet mill, a Henschel mixer, a coffee mill, a food processor, and the like.

Surfactant

The aqueous medium in which resinous particles are aggregated and grown up by the salting-out/aggregation preferably contains an anionic surfactant. While a nonionic or cationic surfactant can be employed in addition to the anionic surfactant, it is preferred to contain only the anionic surfactant without nonionic or cationic surfactant because the particle size of the aggregated particles is controlled precisely. The anionic surfactant may be added to the dispersion at the process of salting-out/aggregation or may be carried in the dispersion at the process of salting-out/aggregation from the dispersion of resinous particles.

The preferable anionic surfactants are exemplified.

Listed as anionic surface active agents are sulfonic acid salts (sodium dodecylbenzenesulfonate, sodium aryl alkyl polyethersulfonate, sodium 3,3-disulfondiphenylurea-4,4-diazo-bis-amino-8-naphthol-6-sulfonate, sodium ortho-caroxybenzene-azo-dimethylaniline-2,2,5,5-tetramethyl-triphenylmethane-4,4-diazi-bis-β-naphthol-6-sulfonate, and the like), sulfuric acid ester salts (sodium dodecylsulfonate, sodium tetradecylsulfonate, sodium pentadecylsulfonate, sodium octylsulfonate, and the like), fatty acid salts (sodium oleate, sodium laureate, sodium caprate, sodium caprylate, sodium caproate, potassium stearate, calcium oleate, and the like).

The toner according to the invention is preferably produced by the following procedure, in which the composite resinous particle is formed in the presence of no colorant, a dispersion of the colored particles is added to the dispersion of the composite resinous particles and the composite resinous particles and the colored particles are salted-out and coagulated.

In the foregoing procedure, the polymerization reaction is not inhibited since the preparation of the composite resinous particle is performed in the system without colorant. Consequently, the anti-offset property is not deteriorated and contamination of the apparatus and the image caused by the accumulation of the toner is not occurred.

Moreover, the monomer or the oligomer is not remained in the toner particle since the polymerization reaction for forming the composite resinous particle is completely performed. Consequently, any offensive odor is not occurred in the fixing process by heating in the image forming method using such the toner.

Each of the constituting materials used in the toner producing process is described in detail below.

Polymerizable Monomer

A hydrophobic monomer is essentially used as the polymerizable monomer for producing the resin or binder used in the invention and a cross-linkable monomer is used according to necessity. As is described below, it is preferable to contain at least one kind of a monomer having an acidic polar group and a monomer having a basic polar group.

(1) Hydrophobic Monomer

The hydrophobic monomer can be used, one or more kinds of which may be used for satisfying required properties.

Specifically, employed may be aromatic vinyl monomers, acrylic acid ester based monomers, methacrylic acid ester based monomers, vinyl ester based monomers, vinyl ether based monomers, monoolefin based monomers, diolefin based monomers, halogenated olefin monomers, and the like.

Listed as aromatic vinyl monomers, for example, are styrene based monomers and derivatives thereof such as styrene, o-methylstyrene, m-methylstyrene, p-methylstyrene, p-methoxystyrene, p-phenylstyrene, p-chlorostyrene, p-ethylstyrene, p-n-butylstyrene, p-tert-butylstyrene, p-n-hexylstyrene, p-n-octylstyrne, p-n-nonylstyrene, p-n-decylstyrene, p-n-dodecylstyrene, 2,4-dimethylstyrne, 3,4-dichlorostyrene, and the like.

Listed as acrylic acid ester bases monomers and methacrylic acid ester monomers are methyl acrylate, ethyl acrylate, butyl acrylate, 2-ethylhexyl acrylate, cyclohexyl acrylate, phenyl acrylate, methyl methacrylate, ethyl methacrylate, butyl methacrylate, hexyl methacrylate, 2-ethylhexyl methacrylate, ethyl β-hydroxyacrylate, propyl γ-aminoacrylate, stearyl methacrylate, dimethyl aminoethyl methacrylate, diethyl aminoethyl methacrylate, and the like.

Listed as vinyl ester based monomers are vinyl acetate, vinyl propionate, vinyl benzoate, and the like.

Listed as vinyl ether based monomers are vinyl methyl ether, vinyl ethyl ether, vinyl isobutyl ether, vinyl phenyl ether, and the like.

Listed as monoolefin based monomers are ethylene, propylene, isobutylene, 1-butene, 1-pentene, 4-methyl-1-pentene, and the like. Listed as diolefin based monomers are butadiene, isoprene, chloroprene, and the like.

Listed as halogenated olefin based monomers are vinyl chloride, vinylidene chloride, vinyl bromide, and the like.

(2) Crosslinking Monomers

In order to improve the desired properties of toner, added as crosslinking monomers may be radical polymerizable crosslinking monomers. Listed as radical polymerizable agents are those having at least two unsaturated bonds such as divinylbenzene, divinylnaphthalene, divinyl ether, diethylene glycol methacrylate, ethylene glycol dimethacrylate, polyethylene glycol dimethacrylate, phthalic acid diallyl, and the like.

(3) Monomer Having an Acidic Polar Group

As the monomer having an acidic polar group, (a) a polymerizable monomer containing a carboxylic acid group (—COOH) and (b) a polymerizable monomer containing a sulfonic acid group (—$SO_3H$) can be cited.

Examples of the polymerizable monomer containing the carboxylic acid group (—COOH) of (a) include acrylic acid, methacrylic acid, fumaric acid, maleic acid, itaconic acid, cinnamic acid, maleic acid mono-butyl ester, maleic acid mono-octyl ester and their sodium salts, zinc salts, etc.

Examples of the polymerizable monomer containing the sulfonic acid group (—$SO_3H$) of (b) include sulfonated styrene and its Na salt, allylsulfo succinic acid, allylsulfo succinic acid octyl ester and their sodium salts.

The polymerizable monomer containing a carboxylic acid group (—COOH) mentioned above (a) is preferably employed, and, for example, methacrylic acid and acrylic acid are preferably employed particularly.

(4) Monomer Having a Basic Polar Group

As the monomer having a basic polar group, can be cited (i) (meth)acrylic acid ester obtained by reacting (meth) acrylic acid with an aliphatic alcohol, which has 1 to 12 carbon atoms, preferably 2 to 8 carbon atoms, specifically preferably 2 carbon atoms, and which also has an amino group or a quaternary ammonium group, (ii) (meth)acrylic acid amide or (meth)acrylic acid amide having mono-alkyl group or di-alkyl group, having 1 to 18 carbon atoms, substituted on its N atom, (iii) vinyl compound substituted with a heterocyclic group having at least a nitrogen atom in said heterocyclic group, (iv) N,N-di-allyl-alkylamine or its quaternary salt. Of these, (meth)acrylic acid ester obtained by reacting (meth)acrylic acid with the aliphatic alcohol having the amino group or the quaternary ammonium group is preferred.

Examples of (meth)acrylic acid ester obtained by reacting (meth)acrylic acid with the aliphatic alcohol having the amino group or the quaternary ammonium group of (i) include dimethylaminoethylacrylate, dimethylaminoethylmethacrylate, diethylaminoethylacrylate, diethylaminoethylmethacrylate, quaternary ammonium salts of the above mentioned four compounds, 3-dimethylaminophenylacrylate and 2-hydroxy-3-methacryloxypropyl trimethylammonium salt, etc.

Examples of (meth)acrylic acid amide or (meth)acrylic acid amide having mono-alkyl group or di-alkyl group substituted on its N atom of (ii) include acrylamide, N-butylacrylamide, N,N-dibutylacrylamide, piperidylacrylamide, methacrylamide, N-butylmethacrylamide, N,N-dimethylacrylamide, N-octadecylacrylamide, etc.

Examples of vinyl compound substituted with a heterocyclic group having at least a nitrogen atom in said heterocyclic group of (iii) include vinylpyridine, vinylpyrrolidone, vinyl-N-methylpyridinium chloride, vinyl-N-ethylpyridinium chloride, etc.

Examples of N,N-di-allyl-alkylamine or its quaternary salt of (iv) include N,N-di-allyl-methylammonium chloride, N,N-di-allyl-ethylammonium chloride, etc.

Chain Transfer Agents

For the purpose of regulating the molecular weight of resin particles, it is possible to employ commonly used chain transfer agents.

The chain transfer agents, for example, employed are mercaptans such as octylmercaptan, dodecylmercaptan, tert-dodecylmercaptan, and the like. The compound having mercaptan are preferably employed to give advantageous toner having such characteristics as reduced smell at the time of thermal fixing, sharp molecular weight distribution, good preservavability, fixing strength, anti-off-set and so on. The actual compounds preferably employed include ethyl thioglycolate, propyl thioglycolate, butyl thioglycolate, t-butyl thioglycolate, ethylhexyl thioglycolate, octyl thioglycolate, decyl thioglycolate, dodecyl thioglycolate, an ethyleneglycol compound having mercapto group, a neopentyl glycol compound having mercapto group, and a pentaerythritol compound having mercapto group. Among them n-octyl-3-mercaptopropionic acid ester is preferable in view of minimizing smell at the time of thermal fixing.

Surface Active Agents

In order to perform polymerization employing the aforementioned radical polymerizable monomers, it is required to conduct oil droplet dispersion in a water based medium employing surface active agents. Surface active agents, which are employed for said dispersion, are not particularly limited, and it is possible to cite ionic surface active agents described below as suitable ones.

Listed as ionic surface active agents are sulfonic acid salts (sodium dodecylbenzenesulfonate, sodium aryl alkyl polyethersulfonate, sodium 3,3-disulfondiphenylurea-4,4-diazo-bis-amino-8-naphthol-6-sulfonate, sodium ortho-caroxybenzene-azo-dimethylaniline-2,2,5,5-tetramethyl-triphenylmethane-4,4-diazi-bis-β-naphthol-6-sulfonate, and the like), sulfuric acid ester salts (sodium dodecylsulfonate, sodium tetradecylsulfonate, sodium pentadecylsulfonate, sodium octylsulfonate, and the like), fatty acid salts (sodium oleate, sodium laureate, sodium caprate, sodium caprylate, sodium caproate, potassium stearate, calcium oleate, and the like).

In the present invention, surface active agents represented by General Formulas (1) and (2) are most preferably employed.

$R^1(OR^2)_nOSO_3M$ General Formula (1)

$R^1(OR^2)_nSO_3M$ General Formula (2)

In General Formulas (1) and (2), $R^1$ represents an alkyl group having from 6 to 22 carbon atoms or an arylalkyl group. $R^1$ is preferably an alkyl group having from 8 to 20 carbon atoms or an arylalkyl group and is more preferably an alkyl group having from 9 to 16 carbon atoms or an arylalkyl group.

Listed as alkyl group having from 6 to 22 carbon atoms represented by $R^1$ are, for example, an n-hexyl group, an n-heptyl group, an n-octyl group, an n-decyl group, an n-undecyl group, a hexadecyl group, a cyclopropyl group, a cyclopentyl group, and a cyclohexyl group. Listed as arylalkyl groups represented by $R^1$ are a benzyl.group, a diphenylmethyl group, a cinnamyl group, a styryl group, a trityl group, and a phenethyl group.

In General Formulas (1) and (2), $R^2$ represents an alkylene group having from 2 to 6 carbon atoms. $R^2$ is preferably an alkylene group having 2 or 3 carbon atoms. Listed as alkylene groups having from 2 to 6 carbon atoms represented $R^2$ are an ethylene group, a trimethylene group, a tetramethylene group, a propylene group, and an ethylethylene group.

In General Formulas (1) and (2), n represents an integer of 1 to 11; and n is preferably from 2 to 10, is more preferably from 2 to 5, and is most preferably 2 or 3.

In General Formulas (1) and (2), listed as univalent metal elements represented by M are sodium, potassium, and lithium. Of these, sodium is preferably employed.

Specific examples of surface active agents represented by General Formulas (1) and (2) are illustrated below:

Compound (101): $C_{10}H_{21}(OCH_2CH_2)_2OSO_3Na$

Compound (102): $C_{10}H_{21}(OCH_2CH_2)_3OSO_3Na$

Compound (103): $C_{10}H_{21}(OCH_2CH_2)_2SO_3Na$

Compound (104): $C_{10}H_{21}(OCH_2CH_2)_3SO_3Na$

Compound (105): $C_8H_{17}(OCH_2CH(CH_3))_2OSO_3Na$

Compound (106): $C_{18}H_{37}(OCH_2CH_2)_2OSO_3Na$

In the present invention, from the viewpoint of maintaining the electrostatic charge holding function of toner in the desired state, minimizing fogging at high temperature and high humidity, and improving transferability, as well as minimizing an increase in electrostatic charge at low temperature and low humidity, and stabilizing the development amount, the content of the surface active agents represented by the aforesaid General Formulas (1) and (2) in the electrostatic image developing toner is preferably from 1 to 1,000 ppm, is more preferably from 5 to 500 ppm, and is most preferably from 7 to 100 ppm.

In the present invention, by adjusting the amount of the surface active agents incorporated to said range, the static charge of the electrostatic image developing toner of the present invention is built up being independent of ambience, and can be uniformly and stably provided and maintained.

Further, the content of the surface active agents represented by the aforesaid General Formulas (1) and (2) is calculated employing the method described below.

One g of toner is dissolved in chloroform, and surface active agents are extracted from the chloroform layer employing 100 ml of deionized water. Further, said chloroform layer, which has been extracted, is further extracted employing 100 ml of deionized water, whereby 200 ml of extract (being a water layer) is obtained, which is diluted to 500 ml.

The resulting diluted solution is employed as a test solution which is subjected to coloration utilizing Methylene Blue based on the method specified in JIS 33636. Then, its absorbance is determined, and the content of the surface active agents in the toner is determined employing the independently prepared calibration curve.

Further, said extract is analyzed employing 1H-NMR, and the structure of the surface active agents represented by General Formulas (1) and (2) is determined.

Further, it is possible to employ nonionic surface active agents. Specifically, it is possible to cite polyethylene oxide, polypropylene oxide, a combination of polypropylene oxide and polyethylene oxide, alkylphenol polyethylene oxide, esters of polyethylene glycol with higher fatty acids, esters of polypropylene oxide with higher fatty acids, sorbitan esters, and the like.

The surface active agent is employed mainly as an emulsifier, and may be used for other purpose in the other process.

Molecular Weight Distribution of Resinous Particles and Toner

Resins used in the toner has a peak or a shoulder within the ranges of preferably from 100,000 to 1,000,000 and from 1,000 to 50,000, and more preferably in the ranges from 100,000 to 1,000,000, from 25,000 to 150,000 and from 1,000 to 50,000 in the molecular weight distribution.

The resinous particles preferably comprises "a high molecular weight resin" having a peak or a shoulder within the range of from 100,000 to 1,000,000, and "a low molecular weight resin" having a peak or a shoulder within the range of from 1,000 to 50,000, and more preferably "a middle molecular weight resin" having a peak or a shoulder within the range of from 15,000 to 100,000, in the molecular weight distribution.

Molecular weight of the resin composing toner is preferably measured by gel permeation chromatography (GPC) employing tetrahydrofuran (THF).

Added to 1 cc of THF is a measured sample in an amount of 0.5 to 5.0 mg (specifically, 1 mg), and is sufficiently dissolved at room temperature while stirring employing a magnetic stirrer and the like. Subsequently, after filtering the resulting solution employing a membrane filter having a pore size of 0.48 to 0.50 μm, the filtrate is injected in a GPC.

Measurement conditions of GPC are described below. A column is stabilized at 40° C., and THF is flowed at a rate of 1.0 ml per minute. Then measurement is carried out by injecting approximately 100 μl of said sample at a concentration of 1 mg/ml. It is preferable that commercially available polystyrene gel columns are combined and used. For example, it is possible to cite combinations of Shodex GPC KF-801, 802, 803, 804, 805, 806, and 807, produced by Showa Denko Co., combinations of TSKgel G1000H, G2000H, G3000H, G4000H, G5000H, G6000H, G7000H, TSK guard column, and the like. Further, as a detector, a refractive index detector (IR detector) or a UV detector is preferably employed. When the molecular weight of samples is measured, the molecular weight distribution of said sample is calculated employing a calibration curve which is prepared employing monodispersed polystyrene as standard particles. Approximately ten polystyrenes samples are preferably employed for determining said calibration curve.

<Colorants>

The toner is obtained by salting out/fusing the composite resinous particles and colored particles.

Listed as colorants which constitute the toner of the present invention may be inorganic pigments, organic pigments, and dyes.

Employed as said inorganic pigments may be those conventionally known in the art. Specific inorganic pigments are listed below.

Employed as black pigments are, for example, carbon black such as furnace black, channel black, acetylene black, thermal black, lamp black, and the like, and in addition, magnetic powders such as magnetite, ferrite, and the like.

If desired, these inorganic pigments may be employed individually or in combination of a plurality of these. Further, the added amount of said pigments is commonly between 2 and 20 percent by weight with respect to the polymer, and is preferably between 3 and 15 percent by weight.

The magnetite can be added to the resinous particles when the toner is used as a magnetic toner. In this instance the magnetite is added in an amount of from 20 to 60 weight % of the toner particle in view of obtaining necessary magnetic characteristics.

The organic pigment or organic dye is also employed, examples thereof are listed.

Listed as pigments for magenta or red are C.I. Pigment Red 2, C.I. Pigment Red 3, C.I. Pigment Red 5, C.I. Pigment Red 6, C.I. Pigment Red 7, C.I. Pigment Red 15, C.I. Pigment Red 16, C.I. Pigment Red 48:1, C.I. Pigment Red 53:1, C.I. Pigment Red 57:1, C.I. Pigment Red 122, C.I. Pigment Red 123, C.I. Pigment Red 139, C.I. Pigment Red 144, C.I. Pigment Red 149, C.I. Pigment Red 166, C.I. Pigment Red 177, C.I. Pigment Red 178, C.I. Pigment Red 222, and the like.

Listed as pigments for orange or yellow are C.I. Pigment Orange 31, C.I. Pigment Orange 43, C.I. Pigment Yellow 12, C.I. Pigment Yellow 13, C.I. Pigment Yellow 14, C.I. Pigment yellow 15, C.I. Pigment Yellow 17, C.I. Pigment Yellow 93, C.I. Pigment Yellow 94, C.I. Pigment Yellow 138, C.I. Pigment Yellow 155, C.I. Pigment Yellow 156, C.I. Pigment yellow 180, C.I. Pigment Yellow 185, Pigment Yellow 155, Pigment Yellow 186, and the like.

Listed as pigments for green or cyan are C.I. Pigment Blue 15, C.I. Pigment Blue 15:2, C.I. Pigment Blue 15:3, C.I. Pigment Blue 16, C.I. Pigment Blue 60, C.I. Pigment Green 7, and the like.

Employed as dyes may be C.I. Solvent Red 1, 59, 52, 58, 63, 111, 122; C.I. Solvent Yellow 19, 44, 77, 79, 81, 82, 93, 98, 103, 104, 112, 162; C.I. Solvent Blue 25, 36, 60, 70, 93, and 95; and the like. Further these may be employed in combination.

If desired, these organic pigments, as well as dyes, may be employed individually or in combination of selected ones. Further, the added amount of pigments is commonly between 2 and 20 percent by weight, and is preferably between 3 and 15 percent by weight.

Said colorants may also be employed while subjected to surface modification. As said surface modifying agents may be those conventionally known in the art, and specifically, preferably employed may be silane coupling agents, titanium coupling agents, aluminum coupling agents, and the like.

Examples of the silane coupling agent include alkoxysilane such as methyltrimethoxysilane, phenyltrimethoxysilane, methylphenyldimethoxysilane and diphenyldimethoxysilane; siloxane such as hexamethyldisiloxane, γ-chloropropyltrimethoxysilane, vinyltrichlorosilane, vinyltrimethoxysilane, vinyltriethoxysilane, γ-methacryloxypropyltrimethoxysilane, γ-glycidoxypropyltrimethoxysilane, γ-mercaptopropyltrimethoxysilane, γ-aminopropyltriethoxysilane, and γ-ureidopropyltriethoxysilane.

Examples of the titanium coupling agent include those marketed with brand "Plainact" TTS, 9S, 38S, 41B, 46B, 55, 138S, 238S etc., by Ajinomoto Corporation, A-1, B-1, TOT, TST, TAA, TAT, TLA, TOG, TBSTA, A-10, TBT, B-2, B-4, B-7, B-10, TBSTA-400, TTS, TOA-30, TSDMA, TTAB, TTOP etc., marketed by Nihon Soda Co., Ltd.

Examples of the aluminum coupling agent include "Plainact AL-M".

These surface modifiers is added preferably in amount of 0.01 to 20% by weight, and more preferably 0.5 to 5% by weight with reference to the colorant.

Surface of the colorant may be modified in such way that the surface modifier is added to the dispersion of colorant, then the dispersion is heated to conduct reaction.

Colorant having subjected to the surface modification is separated by filtration and dried after repeating rinsing and filtering with the same solvent.

Releasing Agent/Crystalline Materials

Toner employed in the invention is preferably prepared by fusing resinous particles containing a releasing agent and colored particles in water based medium and then digesting the obtained particles whereby the releasing agent and the colorant are dispersed in resin matrix adequately to form a domain-matrix structure. Crystalline organic substance includes crystalline polyester which has characteristics improving fixing property. The crystalline organic substance giving releasing property is called releasing agent. Releasing agent has a releasing function displayed at the melt viscosity of 200 cps at 200° C.

Toner particles having the crystalline substance dispersed finely can be obtained by subjecting the resinous particles containing the crystalline substance and the colored particles to salting-out/fusion in the aqueous medium.

Preferable examples of the crystalline material having releasing property include low molecular weight polypropylene having average molecular weight of 1,500 to 9,000 and low molecular weight polyethylene, and a particularly preferable example is an ester compounds represented by General Formula (1), described below.

$$R^3—(OCO—R^4)_n \quad (1)$$

wherein n represents an integer of 1 to 4, and preferably 2 to 4, more preferably 3 or 4, and in particular preferably 4, $R^3$ and $R^4$ each represent a hydrocarbon group which may have a substituent respectively. $R^3$ has from 1 to 40 carbon atoms, and preferably 1 to 20, more preferably 2 to 5. $R^4$ has from 1 to 40 carbon atoms, and preferably 16 to 30, more preferably 18 to 26.

The representative examples are listed.

1)

$$CH_3-(CH_2)_{12}-COO-(CH_2)_{17}-CH_3$$

2)

$$CH_3-(CH_2)_{18}-COO-(CH_2)_{17}-CH_3$$

3)

$$CH_3-(CH_2)_{20}-COO-(CH_2)_{21}-CH_3$$

4)

$$CH_3-(CH_2)_{14}-COO-(CH_2)_{19}-CH_3$$

5)

$$CH_3-(CH_2)_{20}-COO-(CH_2)_6-CH_3-O-CO-(CH_2)_{20}-CH_3$$

6)

$$CH_3-(CH_2)_{20}-COO-(CH_2)_2-\underset{}{\overset{CH_3}{\overset{|}{CH}}}-CH_2-O-CO-(CH_2)_{20}-CH_3$$

7)

$$CH_3-(CH_2)_{22}-COO-(CH_2)_2-\overset{CH_3}{\overset{|}{CH}}-CH_2-O-CO-(CH_2)_{22}-CH_3$$

8)

$$CH_3-(CH_2)_{22}-COO-CH_2-\underset{CH_3}{\overset{CH_3}{C}}-CH_2-O-CO-(CH_2)_{22}-CH_3$$

9)

$$CH_3-(CH_2)_{26}-COO-CH_2-\underset{CH_3}{\overset{CH_3}{C}}-CH_2-O-CO-(CH_2)_{26}-CH_3$$

10)

$$\begin{array}{l} CH_2-O-CO-(CH_2)_{26}-CH_3 \\ | \\ CH-O-CO-(CH_2)_{26}-CH_3 \\ | \\ CH_2-O-CO-(CH_2)_{26}-CH_3 \end{array}$$

11)

$$\begin{array}{l} CH_2-O-CO-(CH_2)_{22}-CH_3 \\ | \\ CH-O-CO-(CH_2)_{22}-CH_3 \\ | \\ CH_2-O-CO-(CH_2)_{22}-CH_3 \end{array}$$

12)

$$\begin{array}{l} CH_2-OH \\ | \\ CH-O-CO-(CH_2)_{26}-CH_3 \\ | \\ CH_2-O-CO-(CH_2)_{26}-CH_3 \end{array}$$

13)

$$\begin{array}{l} CH_2-OH \\ | \\ CH-O-CO-(CH_2)_{22}-CH_3 \\ | \\ CH_2-O-CO-(CH_2)_{22}-CH_3 \end{array}$$

14)

$$\begin{array}{l} CH_2-OH \\ | \\ CH-OH \\ | \\ CH_2-O-CO-(CH_2)_{26}-CH_3 \end{array}$$

15)

$$\begin{array}{l} CH_2-OH \\ | \\ CH-OH \\ | \\ CH_2-O-CO-(CH_2)_{22}-CH_3 \end{array}$$

-continued

16)

$$CH_3-(CH_2)_{26}-COO-CH_2-\overset{CH_3}{\overset{|}{\underset{CH_2-O-CO-(CH_2)_{26}-CH_3}{\underset{|}{C}}}}-CH_2-O-CO-(CH_2)_{26}-CH_3$$

17)

$$CH_3-(CH_2)_{20}-COO-CH_2-\overset{CH_2CH_3}{\overset{|}{\underset{CH_2-O-CO-(CH_2)_{20}-CH_3}{\underset{|}{C}}}}-CH_2-O-CO-(CH_2)_{20}-CH_3$$

18)

$$CH_3-(CH_2)_{26}-COO-CH_2-\overset{CH_2-O-CO-(CH_2)_{26}-CH_3}{\overset{|}{\underset{CH_2-O-CO-(CH_2)_{26}-CH_3}{\underset{|}{C}}}}-CH_2-O-CO-(CH_2)_{26}-CH_3$$

19)

$$CH_3-(CH_2)_{20}-COO-CH_2-\overset{CH_2-O-CO-(CH_2)_{20}-CH_3}{\overset{|}{\underset{CH_2-O-CO-(CH_2)_{20}-CH_3}{\underset{|}{C}}}}-CH_2-O-CO-(CH_2)_{20}-CH_3$$

20)

$$CH_3-(CH_2)_{18}-COO-CH_2-\overset{CH_2-O-CO-(CH_2)_{18}-CH_3}{\overset{|}{\underset{CH_2-O-CO-(CH_2)_{18}-CH_3}{\underset{|}{C}}}}-CH_2-O-CO-(CH_2)_{18}-CH_3$$

21)

$$CH_3-(CH_2)_{16}-COO-CH_2-\overset{CH_2-O-CO-(CH_2)_{16}-CH_3}{\overset{|}{\underset{CH_2-O-CO-(CH_2)_{16}-CH_3}{\underset{|}{C}}}}-CH_2-O-CO-(CH_2)_{16}-CH_3$$

22)

$$CH_3-(CH_2)_{20}-COO-CH_2-\overset{CH_2-O-CO-CH_3}{\overset{|}{\underset{CH_2-O-CO-CH_3}{\underset{|}{C}}}}-CH_2-O-CO-CH_3$$

As a compound constituting crystalline polyester obtained by reaction of aliphatic diol with an aliphatic dicarboxylic acid (acid anhydride and acid chloride are included) is preferable.

Example of the diol which is used in order to obtain crystalline polyester includes ethylene glycol, diethylene glycol, triethylene glycol, 1,2-propylene glycol, 1,3-propylene glycol, 1,4-butane diol, 1,4-butene diol, neopentyl glycol, 1,5-pentane glycol, 1,6-hexane glycol, 1,4-cyclohexane diol, 1,4-cyclohexane di methanol, dipropylene glycol, polyethylene glycol, polypropylene glycol, poly tetramethylene glycol, bisphenol A, bisphenol Z, and hydrogenated bisphenol A.

As the dicarboxylic acid which is use in order to obtain crystalline polyester and crystalline polyamide, oxalic acid, malonic acid, succinic acid, glutaric acid, adipic acid, pimelic acid, suberic acid, azelaic acid, sebacic acid, maleic acid, fumaric acid, citraconic acid, itaconic acid, glutaconate, n-dodecyl succinic acid, n-dodecenyl succinic acid, iso dodecyl succinic acid, iso dodecenyl succinic acid, n-octyl succinic acid, n-oxotenyl succinic acid, and these acid anhydride or an acid chloride can be mentioned.

In particular as a preferable crystalline polyester compound, polyester obtained by reacting cyclohexane diol or 1,4-cyclohexanedimethanol with adipic acid, polyester obtained by reacting 1,6-hexanediol or 1,4-cyclohexane dimethanol with sebacic acid, polyester obtained by reacting ethylene glycol and succinic acid, polyester obtained by reacting ethylene glycol and sebacic acid, polyester obtained by reacting 1,4-butanediol and succinic acid can be mentioned. Among these, the polyester obtained by reacting cyclohexane diol, 1,4-cyclohexanedimethanol and adipic acid is particularly preferable.

As a containing ratio of the compound in the toner, it is preferable that crystalline polyester is from 1 to 30 percent by weight, and more preferably from 2 to 20 percent by weight, and in particular from 3 to 15 percent by weight of toner weight as a whole.

Process of Adding an External Additive

A process adding an external additive follows the above-mentioned processes in usual toner preparation process, wherein inorganic fine particles such as silica or titanium oxide, and/or organic fine particles such as methacrylate to complete the toner.

<Developers>

The toner of the present invention may be employed in either a single-component developer or a two-component developer.

Listed as single-component developers are a non-magnetic single-component developer, and a magnetic single-component developer in which magnetic particles having a diameter of 0.1 to 0.5 $\mu$m are incorporated into a toner. Said toner may be employed in both developers.

Further, said toner is blended with a carrier and employed as a two-component developer. In this case, employed as magnetic particles of the carrier may be conventional materials known in the art, such as metals such as iron, ferrite, magnetite, and the like, alloys of said metals with aluminum, lead and the like. Specifically, ferrite particles are preferred. The volume average particle diameter of said magnetic particles is preferably 15 to 100 $\mu$m, and is more preferably 25 to 80 $\mu$m.

The volume average particle diameter of said carrier can be generally determined employing a laser diffraction type particle diameter distribution measurement apparatus (SYMPATEC) "HELOS", produced by Japan Laser Corporation, which is provided with a wet type homogenizer.

The preferred carrier is one in which magnetic particles are further coated with resins, or a so-called resin dispersion type carrier in which magnetic particles are dispersed into resins. Resin compositions for coating are not particularly limited. For example, employed are olefin based resins, styrene based resins, styrene-acryl based resins, silicone based resins, ester based resins, or fluorine containing polymer based resins. Further, resins, which constitute said resin dispersion type carrier, are not particularly limited, and resins known in the art may be employed. For example, listed may be styrene-acryl based resins polyester resins, fluorine based resins, phenol resins, and the like.

The image forming apparatus employed in the image forming method using the toner of the invention is described.

Figure 2:
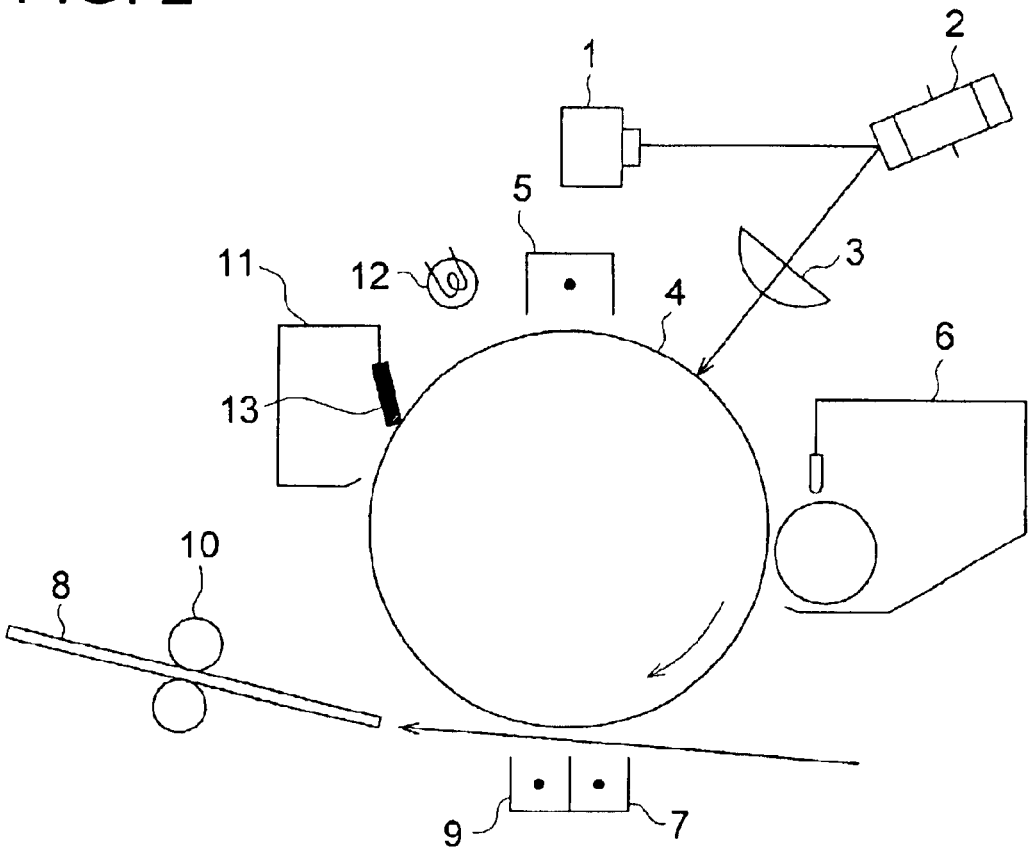
FIG. 2 is a schematic view of cross section of an image forming apparatus to which the toner of the invention can be applied.

A cross-section of an image forming apparatus is shown in FIG. 2 as an example of the color forming apparatus for describing the image forming method. In FIG. 2 numeral 4 shows a photoreceptor drum as a latent image carrier, which is constituted by coating OPC or organic photosensitive substance, on a substrate drum. The photoreceptor drum is grounded and driven so as to be clockwise rotated as is shown in the drawing.

Light exposure is emitted from semiconductor laser diode source 1 according to the image information read in by reading means, not shown in FIG. 2. The light is scanned in a direction perpendicular to the paper plain by a rotating polygon mirror 2, and is exposed to the photoreceptor to form a latent image through an fθ lens 3, which compensate distortion of image. The photoreceptor drum 4 is charged uniformly by a charger 5 previously and starts rotation synchronized with the timing of the image exposure.

The latent image on the photoreceptor is developed by developing device 6, and the developed image is transferred to synchronously driven transferee paper 8 by transfer device 7. The transferee paper 8 is separated from the photoreceptor 4 by separating device (separating pole) 9, and the transferred image on the transferee paper is carried to fixing device 10 to be fixed.

Remaining toner particles on the photoreceptor are swept by cleaning device 11. The residual charge on the photoreceptor is cancelled through precharging exposure light 12, and the photoreceptor is again charged uniformly by charging device 5.

Representative transfer paper includes plain paper. However, it is not particularly limited as long as unfixed images after development can be transferred, and includes a PET base for OHP.

Further, cleaning blade 13 is comprised of an elastic rubber body having a thickness of 1 to 30 mm. As such material, urethane rubber is most frequently employed. Since cleaning blade 13 is employed by being brought into pressure contact with the photoreceptor, it easily transmits heat. As a result, it is preferable to be withdrawn from the photoreceptor by providing a releasing mechanism while the image forming operation is not being performed.

It is possible to apply the present invention to an apparatus utilizing the electrophotographic method, especially an apparatus in which electrostatic images are formed on the photoreceptor, utilizing a modulation beam which has been modulated based on digital image data from a computer.

In recent years, in the electrophotographic field wherein electrostatic latent images are formed on a photoreceptor and the resultant latent images are developed to prepare visible images, increasingly carried out has been research and development of the image forming method utilizing a digital system which makes it possible to easily carry out improvement in image quality, transformation, and edition, and to form high quality images.

As computers which are employed in said image forming method and apparatus thereof, or an optical scanning system which carries out light modulation based on digital image signals from copying original documents, included are a unit in which an acoustic optical modulator is provided via an optical laser system and light modulation is carried out employing said acoustic optical modulator, as well as a unit in which a semiconductor laser is employed and laser intensity is subjected to direct modulation. Spot exposure is carried out onto a uniformly charged photoreceptor from said optical scanning system whereby dot images are formed.

A beam irradiated from said optical scanning system results in a circular or elliptical luminance distribution near the normal distribution having a wide range at both sides. For example, a laser beam in either the primary direction or the secondary direction, or in both directions on the photoreceptor, generally results in extremely narrow circles or ellipses of 20 to 100 $\mu$m.

The toner of the present invention is suitably applied to the image forming method comprising a process in which an image forming support, on which a toner image is formed, is passed between a heating roller and a pressing roller, constituting a fixing unit, so as to fix said image.

Figure 3:
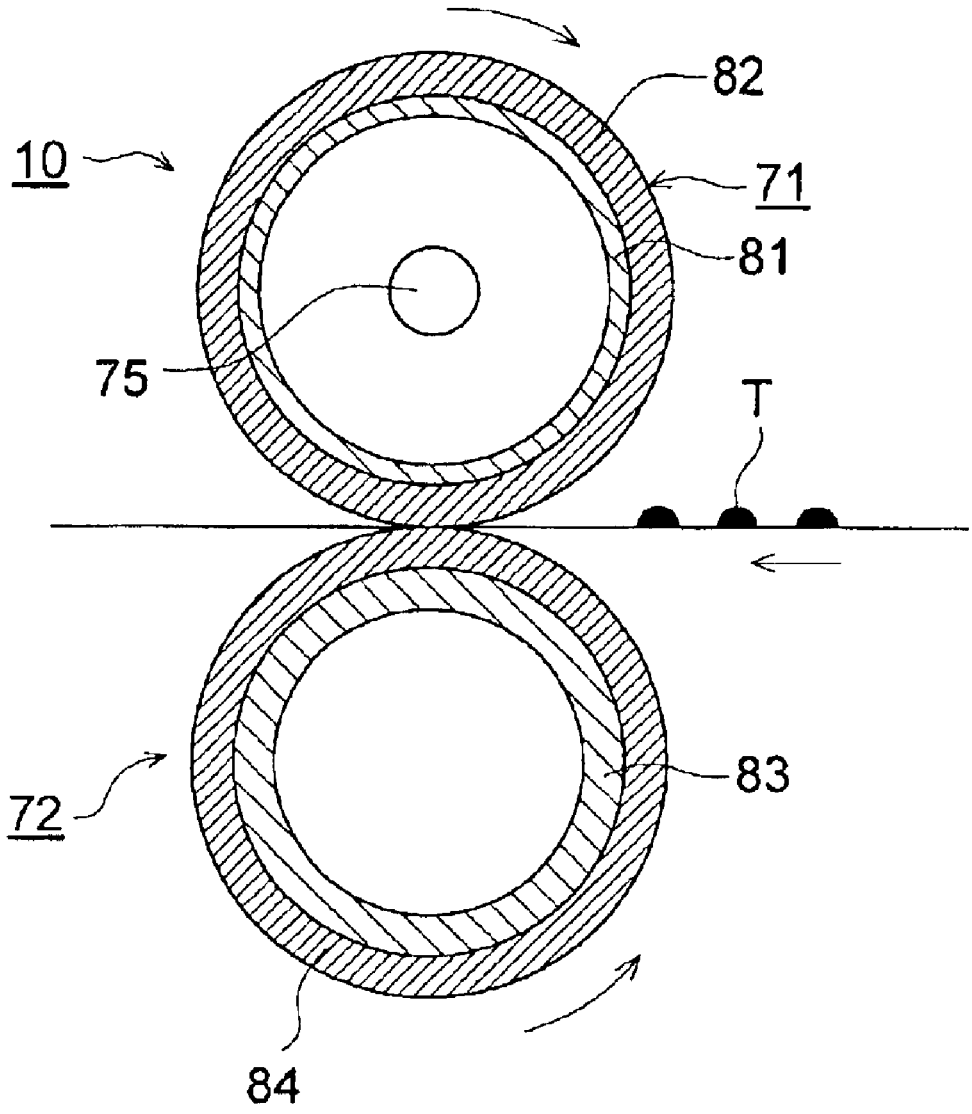
FIG. 3 is a schematic view of cross section of a fixing device to which the toner of the invention can be applied.

FIG. 3 is a cross-sectional view showing one example of a fixing unit used in an image forming method employing the toner of the present invention. Fixing unit 10, shown in FIG. 3, is comprised of heating roller 71, and pressing roller 72 which comes into contact with said heating roller 71. Incidentally, in FIG. 3, T is a toner image formed on a transfer paper (being the image forming support).

Said heating roller 71 is prepared by forming cover layer 82 comprised of fluorine resins or an elastic body on the surface of metal pipe 81 and includes heating member 75 comprised of a linear heater in its interior.

Metal pipe 81 is comprised of metal, and its interior diameter is from 10 to 70 mm. Metals which comprise metal pipe 81 may include, for example, iron, aluminum, and copper, and alloys thereof.

The wall thickness of said metal pipe 81 is from 0.1 to 15 mm, and is determined taking into account the balance between the energy saving demand (a decrease in the wall thickness) and strength (being dependent on composition of the materials). For example, when the strength exhibited by a metal pipe comprised of iron with a wall thickness of 0.57 mm is intended to obtain employing a metal pipe comprised of aluminum, it is preferable to increase its wall thickness to 0.8 mm.

Exemplified as fluorine resins constituting covering layer 82 may be PTFE (polytetrafluoroethylene), PFA (tertafluoroethylene-perfluoroalkyl vinyl ether copolymers), and the like.

The thickness of covering layer made of fluorine resin is usually 10 to 500 $\mu$m, and is preferably 20 to 400 $\mu$m.

The elastic material forming a covering layer 82 includes silicone rubber or silicone sponge, which has good heat resistance, such as LTV, RTV and HTV.

An Asker C harness of the elastic material covering layer 82 is less than 80 degrees, preferably less than 80 degrees.

The thickness of the elastic material covering layer 82 is 0.1 to 30 mm, and preferably 0.1 to 20 mm.

Halogen heaters may be suitably employed as heating member 75.

Pressure roller 72 comprises cylinder 83 having on its surface covering layer 84 comprised of elastic materials. Elastic materials constituting covering layer are not particularly limited, and may include various types of soft rubber such as urethane rubber, silicone rubber, and the like, and also foamed rubber. Silicone rubber as well as silicone sponge rubber is preferably employed, which is exemplified as those constituting covering layer.

The Asker C hardness of elastic materials, constituting covering layer 84, is commonly less than 80 degrees, is preferably less than 70 degrees, and is more preferably less than 60 degrees.

Further, the thickness of covering layer 22 is commonly 0.1 to 30 mm, and is preferably 0.1 to 20 mm.

Materials constituting cylinder 83 include metals such as aluminum, iron, copper, and the like, and alloys thereof.

The contact load (total load) of heating roller 10 applied to pressure roller 72 is usually 40 to 350 N, is preferably 50 to 300 N, and is more preferably 50 to 250 N. Said load is set taking into the strength (the wall thickness of cylinder 81) of heating roller 10. For example, when a heating roller comprised of an iron cylinder having a wall thickness of 0.3 mm is employed, the applied load is preferably not more than 250 N.

Further, from the viewpoint of offsetting resistance as well as fixability, nip width is preferably 4 to 10 mm, and the surface pressure of said nip is preferably $0.6\times10^5$ to $1.5\times10^5$ Pa.

When the fixing unit shown in FIG. 3 is employed, an example of fixing conditions are as follows: fixing temperature (surface temperature of heating roller 10) is 150 to 210° C., and fixing linear speed is 80 to 640 mm/second.

EXAMPLES

The present inventing will now be detailed with reference to examples. The term "part(s)" denotes part(s) by weight.

Example I

Preparation of Resinous Particles

Latex 1HML (1) Preparation of Core Particle (a First Step Polymerization)

Placed into a 5,000 ml separable flask fitted with a stirring unit, a temperature sensor, a cooling pipe, and a nitrogen gas inlet was a surface active agent solution (water based medium) prepared by dissolving 7.08 g of an anionic surface active agent (101) in 3,010 g of deionized water, and the interior temperature was raised to 80° C. under a nitrogen gas flow while stirring at 230 rpm.

(101) $C_{10}H_{21}(OCH_2CH_2)_2OSO_3Na$

Subsequently, a solution prepared by dissolving 9.2 g of a polymerization initiator (potassium persulfate, KPS) in 200 g of deionized water was added to the surface active agent solution and it was heated at 75° C., a monomer mixture solution consisting of 70.1 g of styrene, 19.9 g of n-butyl acrylate, and 10.9 g of methacrylic acid was added dropwise over 1 hour. The mixture underwent polymerization by stirring for 2 hours at 75° C. (a first stage polymerization). Thus latex (a dispersion comprised of higher molecular weight resinous particles) was obtained. The resulting latex was designated as Latex (1H). The Latex (1H) has a peak molecular weight at 138,000.

(2) Forming an Inter Layer (The Second Step Polymerization)

A monomer solution was prepared in such way that 98.0 g of Exemplified Compound 19) was added to monomer mixture solution consisting of 105.6 g of styrene, 30.0 g of n-butyl acrylate, 6.2 g of methacrylic acid, 5.6 g of n-octyl-3-mercaptopropionic acid ester and the mixture was heated to 90° C. to dissolve the monomers in a flask equipped with a stirrer.

Surfactant solution containing 1.6 g of anionic surfactant above mentioned (101) dissolved in 2,700 ml of deionized water was heated to 98° C. To the surfactant solution 28 g (converted in solid content) the latex 1H, dispersion of core particles, was added, then the monomer solution containing the Exemplified Compound 19) was mixed and dispersed by means of a mechanical dispersion machine, "CLEARMIX" (produced by M Technique Ltd.) equipped with circulating pass for 8 hours, and a dispersion (emulsion) containing dispersion particles (oil droplet) was prepared.

Subsequently, initiator solution containing 5.1 g of polymerization initiator (KPS) dissolved in 240 ml of deionized water, and 750 ml of deionized water were added to the dispersion (emulsion). Polymerization was conducted by stirring with heating at 98° C. for 12 hours, as the result, latex (dispersion of composite resinous particles which are composed of resinous particles having higher molecular weight polymer resin covered with an intermediate molecular weight polymer) was obtained (a second step polymerization). The resulting latex was designated as Latex (1HM).

(3) Forming Outer Layer (Third Step Polymerization)

Polymerization initiator solution containing 7.4 g of polymerization initiator KPS dissolved in 200 ml deionized water was added to the latex 1HM, then monomer mixture solution consisting of 300 g of styrene, 95 g of n-butylacrylate, 15.3 g of methacrylic acid, and 10.4 g of n-octyl-3-mercaptoprpionic ester was added dropwise over 1 hour at temperature of 80° C. The mixture underwent polymerization by stirring with heating for 2 hours (a third step polymerization), it was cooled to 28° C. Thus Latex 1HML composed of core composed of higher molecular weight polymer resin, an inter layer composed of an intermediate molecular weight polymer resin and an outer layer composed of lower molecular weight polymer resin in which inter layer the Exemplified Compound 19) was incorporated was obtained. The resulting latex was designated as Latex (1HML).

The polymers composed of composite resinous particles composing the latex 1HML have peaks at molecular weight of 138,000, 80,000 and 13,000, and weight average particular size of the composite resinous particles was 122 nm.

Latex 2HML

Latex 2HML was prepared in the same manner as the preparation of 1HML except that 7.08 g of anionic surface active agent, sodium dodecylsulfonate (SDS) was employed in place of the surface active agent (101). Latex 2HML is a dispersion of composite resinous particle having core part composed of high molecular weight resin, inter layer part composed of middle molecular weight resin and outer layer part composed of low molecular weight resin.

The polymers composed of composite resinous particles composing the latex 2HML have peaks at molecular weight of 138,000, 80,000 and 12,000, and weight average particular size of the latex 2HML was 110 nm.

Examples 1–7 and Comparative Examples 1 and 2

Preparation Colored Particles

Added to 1600 ml of deionized water were 59.0 g of sodium dodecyl sulfite, which were stirred and dissolved. While stirring the resulting solution, 420.0 g of carbon black were gradually added, and subsequently dispersed employing a stirring unit, "CLEARMIX" (produced by M Technique Ltd.). Colorant Dispersion was obtained.

Placed into a four-necked flask fitted with a temperature sensor, a cooling pipe, a nitrogen gas inlet unit, and a stirring unit were 420.7 g (converted in solid content) of Latex (1HML), 900 g of deionized water, and 166 g of Colorant Dispersion, and the resulting mixture was stirred. After adjusting the interior temperature to 30° C., 5 mol/L aqueous sodium hydroxide solution was added to the resulting solution, and the pH was adjusted to 8.

Subsequently, an aqueous solution prepared by dissolving salting-out agent shown in Table 2 in 1,000 ml of deionized water was added at 30° C. over 10 minutes. After setting the resulting mixture aside for 3 minutes, it was heated so that the temperature was increased to 90° C. over 30 minutes to make the particle diameter grown by coagulation.

While maintaining the resulting state, the diameter of coalesced particles was measured employing a "Coulter Counter TA-II". When the volume average particle diameter reached 4 $\mu$m, the growth of particles was terminated by the addition of an aqueous solution prepared by dissolving 80.4 g of sodium chloride in 1,000 ml of deionized water, and further fusion was continually carried out at a liquid media temperature of 85 to 98° C. for 2 hours, while being heated and stirred.

TABLE 2

| Example | Salting-out Agent | Salting-out Termination Agent | Added Amount of Salting-out Agent (g) | Added Amount of Salting-out Termination Agent (g) |
|---|---|---|---|---|
| Example 1 | $MgCl_2$ $6H_2O$ | NaCl | 12.1 | 80.4 |
| Example 2 | $CaCl_2$ $6H_2O$ | $NH_4Cl$ | 13.1 | 96.4 |
| Example 3 | $AlCl_3$ $6H_2O$ | $CaCl_2$ $6H_2O$ | 6.3 | 40.4 |
| Example 4 | Al $(OH)_3$ $6H_2O$ | NaCl | 7.1 | 80.4 |
| Example 5 | $SnCl_4$ | $AlCl_3$ $6H_2O$ | 2.9 | 40.2 |
| Example 6 | $SnCl_4$ | $ZnCl_2$ | 2.9 | 50.6 |
| Example 7 | $TiOSO_4$ | NaCl | 2.4 | 80.4 |
| Comparative Example 1 | $MgCl_2$ $6H_2O$ | Not used | 12.1 | 0.0 |
| Comparative Example 2 | $MgCl_2$ $6H_2O$ | A large amount of water | 12.1 | 0.0 |

Thereafter, the temperature was decreased to 30° C. Subsequently, the pH was adjusted to 2.0 with hydrochloric acid, and stirring was terminated. The resulting coalesced particles were collected through filtration, and washed with deionized water at 45° C. repeatedly. Washed particles were then dried by air at 40° C., and the colored particles were obtained. Toner was obtained by mixing the obtained colored particles with 1 weight % of hydrophobic silica.

Employing combinations shown in Table 2, each toner was produced 10 times, listed as n=1 through 10. Table 3 shows the resultant volume average particle diameters, while Tables 3 and 4 show volume standards, variation coefficients, and their standard deviations.

TABLE 3

| Example | Volume Average Particle Diameter of Toner (in μm) | | | | | | | | | | |
|---|---|---|---|---|---|---|---|---|---|---|---|
| | n = 1 | n = 2 | n = 3 | n = 4 | n = 5 | n = 6 | n = 7 | n = 8 | n = 9 | n = 10 | Standard Deviation |
| Example 1 | 3.94 | 4.07 | 3.93 | 3.93 | 3.93 | 4.09 | 3.93 | 3.93 | 4.02 | 4.04 | 0.07 |
| Example 2 | 3.96 | 3.81 | 4.13 | 3.94 | 3.95 | 4.00 | 3.97 | 4.00 | 4.19 | 4.11 | 0.11 |
| Example 3 | 4.03 | 3.83 | 4.05 | 4.24 | 4.12 | 4.02 | 4.10 | 3.84 | 4.04 | 3.83 | 0.14 |
| Example 4 | 3.75 | 3.70 | 3.81 | 4.00 | 3.93 | 4.04 | 3.74 | 4.26 | 3.71 | 3.98 | 0.18 |
| Example 5 | 4.37 | 3.92 | 3.80 | 4.36 | 3.82 | 4.10 | 3.80 | 4.30 | 4.14 | 4.21 | 0.23 |
| Example 6 | 4.29 | 4.11 | 3.92 | 4.01 | 4.00 | 4.28 | 3.77 | 3.63 | 3.69 | 4.25 | 0.24 |
| Example 7 | 3.83 | 4.29 | 4.33 | 3.84 | 4.10 | 3.68 | 4.25 | 4.35 | 3.78 | 4.31 | 0.26 |
| Comparative Example 1 | 3.11 | 3.30 | 4.66 | 3.19 | 3.88 | 4.66 | 4.81 | 3.12 | 3.21 | 3.38 | 0.71 |
| Comparative Example 2 | 4.49 | 4.80 | 3.37 | 3.33 | 4.61 | 4.23 | 3.77 | 4.48 | 3.66 | 3.81 | 0.53 |

TABLE 4

| Example | Variation Coefficient of Toner Volume Standard (in %) | | | | | | | | | | |
|---|---|---|---|---|---|---|---|---|---|---|---|
| | n = 1 | n = 2 | n = 3 | n = 4 | n = 5 | n = 6 | n = 7 | n = 8 | n = 9 | n = 10 | Standard Deviation |
| Example 1 | 16.92 | 16.54 | 16.63 | 16.55 | 16.74 | 16.74 | 16.61 | 16.95 | 16.94 | 16.51 | 0.17 |
| Example 2 | 16.79 | 16.97 | 16.97 | 16.99 | 16.82 | 16.73 | 15.37 | 15.47 | 17.36 | 15.37 | 0.77 |
| Example 3 | 17.45 | 17.93 | 16.64 | 17.87 | 17.87 | 17.61 | 17.84 | 16.68 | 17.04 | 16.41 | 0.59 |
| Example 4 | 17.64 | 16.34 | 17.38 | 17.07 | 17.09 | 17.03 | 17.40 | 17.07 | 17.90 | 17.63 | 0.44 |
| Example 5 | 19.65 | 19.07 | 18.60 | 19.32 | 19.36 | 17.84 | 18.53 | 18.27 | 19.15 | 17.60 | 0.69 |
| Example 6 | 17.76 | 19.99 | 18.22 | 19.64 | 18.70 | 18.37 | 19.02 | 18.11 | 18.15 | 19.82 | 0.80 |
| Example 7 | 17.95 | 18.26 | 18.40 | 19.70 | 19.21 | 18.45 | 18.81 | 17.27 | 18.52 | 17.35 | 0.75 |
| Comparative Example 1 | 16.27 | 22.29 | 16.21 | 23.88 | 16.54 | 20.67 | 20.54 | 20.81 | 22.75 | 22.75 | 2.91 |
| Comparative Example 2 | 18.06 | 17.38 | 14.67 | 19.26 | 14.77 | 14.10 | 20.62 | 17.89 | 15.68 | 17.81 | 2.15 |

Image Printing Evaluation

Ten weight parts of each of 10 lots of each toner, which had been prepared under the same production conditions as described above, were blended and the resultant blend was subjected to image printing evaluation. Employed as an image forming apparatus was a commercially available digital copier, Sitios Konica 7075 (manufactured by Konica Corp.). Employed as a developer was a silicone coated carrier having a volume average particle diameter of 60 μm, and said carrier was blended with each toner so as to obtain a toner concentration of 6 percent by weight.

Copied images were prepared as follows. An A4 original text document, having a black area ratio of 5 percent, was printed onto an A4 copy paper sheet with neither magnification nor reduction.

Evaluation Items and Evaluation Criteria

<Ambient Difference>

Under an ambience of high temperature and high humidity (30° C. and 80 percent relative humidity), or low temperature and low humidity (10° C. and 20 percent relative humidity), 5,000 sheets were printed. At each ambience, the resultant electrostatic charge amount and image density were compared. Said electrostatic charge was determined employing a blow-of method, while, with regard to the image density, the reflection density of a solid image on a 15 mm square was determined employing a Macbeth Densitometer.

With regard to the printing mode, 50 original documents were copied 100 times.

An ambient difference of the electrostatic charge amount, being at most 10 μC/g, is at the commercially viable level. Further, an image density, being at least 1.4, is at the commercially viable level.

Table 5 below shows the results.

TABLE 5

| | Electrostatic Charge Amount $Q_L$ at Low Temperature and Low Humidity (in μC/g) | Electrostatic Charge Amount $Q_H$ at High Temperature and High Humidity (in μC/g) | $Q_L - Q_H$ (in μC/g) | Image Density $D_L$ at Low Temperature and Low Humidity | Image Density $D_H$ at High Temperature and High Humidity | $D_H - D_L$ |
|---|---|---|---|---|---|---|
| Example | 36.4 | 34.2 | 2.2 | 1.44 | 1.47 | 0.03 |
| Example 1 | 35.40 | 33.10 | 2.3 | 1.43 | 1.46 | 0.03 |
| Example 2 | 36.70 | 31.9 | 4.8 | 1.42 | 1.46 | 0.04 |
| Example 3 | 38.40 | 33.40 | 5 | 1.43 | 1.47 | 0.04 |

TABLE 5-continued

| | Electrostatic Charge Amount $Q_L$ at Low Temperature and Low Humidity (in $\mu$C/g) | Electrostatic Charge Amount $Q_H$ at High Temperature and High Humidity (in $\mu$C/g) | $Q_L - Q_H$ (in $\mu$C/g) | Image Density $D_L$ at Low Temperature and Low Humidity | Image Density $D_H$ at High Temperature and High Humidity | $D_H - D_L$ |
|---|---|---|---|---|---|---|
| Example 4 | 35.40 | 30.10 | 5.3 | 1.41 | 1.47 | 0.06 |
| Example 5 | 37.80 | 31.90 | 5.9 | 1.42 | 1.46 | 0.04 |
| Example 6 | 39.40 | 31.40 | 8 | 1.42 | 1.46 | 0.04 |
| Example 7 | 37.70 | 30.10 | 7.6 | 1.40 | 1.45 | 0.05 |
| Comparative Example 1 | 44.30 | 28.10 | 16.2 | 1.26 | 1.47 | 0.21 |
| Comparative Example 2 | 42.50 | 27.40 | 15.1 | 1.27 | 1.47 | 0.20 |

<Printing Mode Difference>

At an ambience of low temperature and low humidity, printing was carried out continously onto 5,000 sheets and also onto every other sheet. Subsequently, each of electrostatic charge amount and the image density was compared.

Table 6 below shows the results.

TABLE 6

| | Electrostatic Charge Amount $Q_c$ of Continuous Printing (in $\mu$C/g) | Electrostatic Charge Amount $Q_i$ of Intermittent Printing ($\mu$C/g) | $Q_c - Q_i$ (in $\mu$C/g) | Image Density $D_c$ of Continuous Printing | Image Density $D_i$ of Intermittent Printing | $D_i - D_c$ |
|---|---|---|---|---|---|---|
| Example | 36.4 | 34.2 | 2.2 | 1.43 | 1.44 | 0.01 |
| Example 1 | 35.40 | 33.10 | 2.3 | 1.42 | 1.44 | 0.02 |
| Example 2 | 36.70 | 31.9 | 4.8 | 1.41 | 1.43 | 0.02 |
| Example 3 | 38.40 | 33.40 | 5 | 1.41 | 1.43 | 0.02 |
| Example 4 | 35.40 | 30.10 | 5.3 | 1.40 | 1.42 | 0.02 |
| Example 5 | 37.80 | 31.90 | 5.9 | 1.40 | 1.42 | 0.02 |
| Example 6 | 39.40 | 31.40 | 8 | 1.41 | 1.42 | 0.01 |
| Example 7 | 37.70 | 30.10 | 7.6 | 1.40 | 1.42 | 0.02 |
| Comparative Example 1 | 44.30 | 28.10 | 16.2 | 1.24 | 1.41 | 0.17 |
| Comparative Example 2 | 42.50 | 27.40 | 15.1 | 1.22 | 1.40 | 0.18 |

<Toner Spent>

Thereafter, printing test was continued until 1,000,000 sheets, and the toner spent amount was determined at the 1,000,000th sheet. After separating the toner from each developer utilizing an aqueous surface active agent solution, 3 g of the resulting carrier was washed with 100 ml of acetone, and the transmittance at a wavelength of 500 nm was determined employing as spectrophotometer. When said transmittance is at least 70 percent, it is possible to continuously use the toner without resulting in insufficient charging.

Further, the background stain density of the white image of the 1,000,000th print was determined employing a Macbeth Reflection Densitometer. When the relative density with respect to a non-printed transfer sheet (plain paper sheet) is at most 0.005, no problems occurred.

Table 7 below shows the results.

TABLE 7

| | Toner Spent (in %) | Background Stain Density (–) |
|---|---|---|
| Example | 86.4 | 0.001 |
| Example 1 | 84.4 | 0.001 |

TABLE 7-continued

| | Toner Spent (in %) | Background Stain Density (–) |
|---|---|---|
| Example 2 | 82.1 | 0.001 |
| Example 3 | 80.1 | 0.001 |
| Example 4 | 81.7 | 0.001 |
| Example 5 | 78.4 | 0.002 |
| Example 6 | 77.6 | 0.002 |
| Example 7 | 75.9 | 0.003 |
| Comparative Example 1 | 60.4 | 0.009 |
| Comparative Example 2 | 64.5 | 0.008 |

Based on all the evaluation results shown in Tables 3 through 7 above, it is found that Examples 1 through 7 of the present invention exhibited superior characteristics when compared to Comparative Examples 1 and 2.

The present invention provides a production method of an electrostatic latent image developing toner having a narrow particle size distribution as well as a narrow electrostatic charge distribution, which is capable of controlling the toner particle diameter at high accuracy. Further, the present invention is capable of providing an electrostatic latent image developing toner in which the electrostatic charge amount (the electric charge amount) does not vary due to humidity and printing modes.

Example II

Preparation of Resinous Particles

Latex 3HML (1) Preparation of Core Particle (a First Step Polymerization)

Placed into a 5,000 ml separable flask fitted with a stirring unit, a temperature sensor, a cooling pipe, and a nitrogen gas inlet was a surface active agent solution (water based medium) prepared by dissolving 7.08 g of an anionic surface active agent (101) in 3,010 g of deionized water, and the interior temperature was raised to 80° C. under a nitrogen gas flow while stirring at 230 rpm.

(101) $C_{10}H_{21}(OCH_2CH_2)_2OSO_4Na$

Subsequently, a solution prepared by dissolving 9.2 g of a polymerization initiator (potassium persulfate, KPS) in 200 g of deionized water was added to the surface active agent solution and it was heated at 75° C., a monomer mixture solution consisting of 70.1 g of styrene, 19.9 g of n-butyl acrylate, and 10.9 g of methacrylic acid was added dropwise over 1 hour. The mixture underwent polymerization by stirring for 2 hours at 75° C. (a first stage polymerization). Thus latex (a dispersion comprised of higher molecular weight resinous particles) was obtained. The resulting latex was designated as Latex 3H. The Latex 3H has a peak molecular weight at 138,000.

(2) Forming an Inter Layer (The Second Step Polymerization)

A monomer solution was prepared in such way that 98.0 g of Exemplified Compound 19) was added to monomer mixture solution consisting of 105.6 g of styrene, 30.0 g of n-butyl acrylate, 15.4 g of methacrylic acid, 5.6 g of n-octyl-3-mercaptopropionic acid ester and the mixture was heated to 90° C. to dissolve the monomers in a flask equipped with a stirrer.

Surfactant solution containing 1.6 g of anionic surfactant above mentioned (101) dissolved in 2,700 ml of deionized water was heated to 98° C. To the surfactant solution 28 g (converted in solid content) the latex 3H, dispersion of core particles, was added, then the monomer solution containing the Exemplified Compound 19) was mixed and dispersed by means of a mechanical dispersion machine, "CLEARMIX" (produced by M Technique Ltd.) equipped with circulating pass for 8 hours, and a dispersion (emulsion) containing dispersion particles (oil droplet) was prepared.

Subsequently, initiator solution containing 5.1 g of polymerization initiator (KPS) dissolved in 240 ml of deionized water, and 750 ml of deionized water were added to the dispersion (emulsion). Polymerization was conducted by stirring with heating at 98° C. for 12 hours, as the result, latex (dispersion of composite resinous particles which are composed of resinous particles having higher molecular weight polymer resin covered with an intermediate molecular weight polymer) was obtained (a second step polymerization). The resulting latex was designated as Latex (3HM).

(3) Forming Outer Layer (Third Step Polymerization)

Polymerization initiator solution containing 7.4 g of polymerization initiator KPS dissolved in 200 ml deionized water was added to the latex 2HM, then monomer mixture solution consisting of 300 g of styrene, 95 g of n-butylacrylate, 35.4 g of methacrylic acid, and 10.4 g of n-octyl-3-mercaptoprpionic ester was added dropwise over 1 hour at temperature of 80° C. The mixture underwent polymerization by stirring with heating for 2 hours (a third step polymerization), it was cooled to 28° C. Thus Latex 2HML composed of core composed of higher molecular weight polymer resin, an inter layer composed of an intermediate molecular weight polymer resin and an outer layer composed of lower molecular weight polymer resin in which inter layer the Exemplified Compound 19) was incorporated was obtained. The resulting latex was designated as Latex (3HML).

The polymers composed of composite resinous particles composing the latex 1HML have peaks at molecular weight of 138,000, 87,000 and 14,500, and weight average particular size of the composite resinous particles was 124 nm.

Latex 4HML

Latex 4HML was prepared in the same manner as the preparation of 3HML except that the methacrylic acid was employed in an a mount of 10.5 g in place of 15.4 g at the preparation of inter layer (second polymerization stage), and the methacrylic acid was employed in an a mount of 18.5 g in place of 35.4 g at the preparation of outer layer (third polymerization stage). Latex 4HML is a dispersion of composite resinous particle having core part composed of high molecular weight resin, inter layer part composed of middle molecular weight resin and outer layer part composed of low molecular weight resin.

The polymers composed of composite resinous particles composing the latex 4HML have peaks at molecular weight of 118,000, 80,000 and 13,500, and weight average particular size of the latex 4HML was 110 nm.

Examples 21–23 and Comparative Examples 21–23

Preparation Colored Particles

Added to 1600 ml of deionized water were 59.0 g of sodium dodecyl sulfite, which were stirred and dissolved. While stirring the resulting solution, 420.0 g of carbon black were gradually added, and subsequently dispersed employing a stirring unit, "CLEARMIX" (produced by M Technique Ltd.). Colorant Dispersion was obtained.

Placed into a four-necked flask fitted with a temperature sensor, a cooling pipe, a nitrogen gas inlet unit, and a stirring unit were 420.7 g (converted in solid content) of Latex 3HML, 900 g of deionized water, and 166 g of Colorant Dispersion, and the resulting mixture was stirred. After adjusting the interior temperature to 30° C., 5 mol/L aqueous sodium hydroxide solution was added to the resulting solution, and the pH was adjusted to 9.

Subsequently, an aqueous solution prepared by dissolving salting-out agent shown in Table 8 in 1,000 ml of deionized water was added at 30° C. over 10 minutes. After setting the resulting mixture aside for 3 minutes, it was heated so that the temperature was increased to 90° C. over 30 minutes to make the particle diameter grown by coagulation.

While maintaining the resulting state, the diameter of coalesced particles was measured employing a "Coulter Counter TA-II". When the volume average particle diameter reached 4 $\mu$m, the growth of particles was terminated by the addition of an aqueous solution prepared by dissolving 80.4 g of sodium chloride in 1,000 ml of deionized water, and further fusion was continually carried out at a liquid media temperature of 85 to 98° C. for 2 hours, while being heated and stirred.

Thereafter, the temperature was decreased to 30° C. Subsequently, the pH was adjusted to 2.0 with hydrochloric acid, and stirring was terminated. The resulting coalesced particles were collected through filtration, and washed with deionized water at 45° C. repeatedly. Washed particles were then dried by air at 40° C., and the colored particles were obtained. Toner was obtained by mixing the obtained colored particles with 1 weight % of hydrophobic silica.

Examples 24–26 and Comparative Examples 24 and 25

Toner Examples 24–26 and Comparative Examples 24 and 25 were obtained in the similar way as Example 21 except that Latex 4HML was employed in place of 3HML and the combination of salting-out agents with salting stop agent shown in Table 8 were employed.

TABLE 8

| Example | Polymer Particle No. | Salting-out Agent | Salting-out Termination Agent | Added Amount of Salting-out Agent (g) | Added Amount of Salting-out Termination Agent (g) |
|---|---|---|---|---|---|
| Example 21 | 1 | $MgCl_2$ $6H_2O$ | NaCl | 12.1 | 80.4 |
| Example 22 | 1 | $MgCl_2$ $6H_2O$ | NaCl | 24.2 | 40.2 |
| Example 23 | 1 | $MgCl_2$ $6H_2O$ | NaCl | 7.5 | 56.1 |
| Example 24 | 2 | $CaCl_2$ $6H_2O$ | NaCl | 36.1 | 160.8 |
| Example 25 | 2 | $AlCl_3$ $6H_2O$ | $CaCl_2$ $6H_2O$ | 2.9 | 4.0 |
| Example 26 | 2 | Al $(OH)_3$ $6H_2O$ | NaCl | 9.2 | 80.4 |
| Comparative Example 21 | 1 | $MgCl_2$ $6H_2O$ | Not used | 12.1 | 0.0 |
| Comparative Example 22 | 1 | $MgCl_2$ $6H_2O$ | NaCl | 42.4 | 64.2 |
| Comparative Example 23 | 1 | $MgCl_2$ $6H_2O$ | NaCl | 12.1 | 0.01 |
| Comparative Example 24 | 2 | $AlCl_3$ $6H_2O$ | $CaCl_2$ $6H_2O$ | 12.1 | 1.6 |
| Comparative Example 25 | 2 | $AlCl_3$ $6H_2O$ | NaCl | 12.1 | 1.6 |

For each sample "a", "b", "a/b", content of methacrylate, and Tg at the first and the second temperature increasing process were measured or calculated. The results are shown in Table 9. The content of methacrylate was measured by means of pyrolysis gas chromatography.

TABLE 9

| Example | a (%) | b (%) | a/b | Metal Salt corresponding to a | Metal Salt corresponding to b | Content of meth-acrylate (%) | Tg at 1st temperature increasing process | Tg at 2nd temperature increasing process |
|---|---|---|---|---|---|---|---|---|
| Example 21 | 0.71 | 0.49 | 1.45 | $MgCl_2$ | NaCl | 9 | 54.9 | 46.6 |
| Example 22 | 1.42 | 0.26 | 5.46 | $MgCl_2$ | NaCl | 9 | 62.1 | 53.8 |
| Example 23 | 0.44 | 0.36 | 1.22 | $MgCl_2$ | NaCl | 9 | 51.4 | 44.1 |
| Example 24 | 1.87 | 0.94 | 1.99 | $CaCl_2$ | NaCl | 6 | 59.8 | 49.4 |
| Example 25 | 0.12 | 0.02 | 6.00 | $AlCl_3$ | $CaCl_2$ | 6 | 52.1 | 44.1 |
| Example 26 | 0.44 | 0.39 | 1.13 | Al $(OH)_3$ | NaCl | 6 | 54.4 | 47.5 |
| Comparative Example 21 | 0.75 | 0.00 | — | $MgCl_2$ | — | 9 | 55.4 | 55.3 |
| Comparative Example 22 | 2.40 | 0.31 | 7.74 | $MgCl_2$ | NaCl | 9 | 64.5 | 60.7 |
| Comparative Example 23 | 0.94 | 0.91 | 1.03 | $MgCl_2$ | NaCl | 9 | 54.1 | 52.1 |
| Comparative Example 24 | 0.08 | 0.01 | 8.00 | $AlCl_3$ | $CaCl_2$ | 6 | 58.7 | 57.4 |
| Comparative Example 25 | 2.00 | 1.10 | 1.80 | $AlCl_3$ | NaCl | 9 | 58.0 | 44.1 |

Image Printing Evaluation

Ten weight parts of each of 10 lots of each toner, which had been prepared under the same production conditions as described above, were blended and the resultant blend was subjected to image printing evaluation. Employed as an image forming apparatus was a commercially available digital copier, Sitios Konica 7075 (manufactured by Konica Corp.). Employed as a developer was a silicone coated carrier having a volume average particle diameter of 60 $\mu$m, and said carrier was blended with each toner so as to obtain a toner concentration of 6 percent by weight.

Copied images were prepared as follows. An A4 original text document, having a black area ratio of 5 percent, was printed onto an A4 copy paper sheet with neither magnification nor reduction.

<Storage Stability of Toner>

One gram of each toner was set aside at 90 percent relative humidity for 24 hours. Subsequently, residual aggregates on a 80 mesh sieve were weighed.

A: excellent: less than 5 percent
B: good: 5 to less than 10 percent
C: commercially viable: 10 to less than 30 percent
D: commercially unviable: at least 30 percent <Fixability Temperature Range>

Fixed images were prepared while varying the temperature of the heating roller from 130 to 240° C. in steps of 10° C. Incidentally, upon outputting fixed images, plain A4 paper sheets (having a basis weight of 64 g/m$^2$) were employed.

The fixation strength of the resultant fixed images was evaluated based on the fixation ratio which was obtained employing the method in accordance with the mending tape peeling method described in Chapter 9, 1.4 Item of "Denshishashin Gijutsu no Kiso to ohyoh (Basis and Application of Electrophotographic Technology), edited by Denshishashin Gakkai.

Specifically, after preparing a fixed solid image of 2.54 cm square having a toner adhesion amount of 0.6 mg/cm$^2$, the image density before and after peeling off Scotch Mending Tape (manufactured by Sumitomo 3M Limited) was determined and the residual ratio of the image density was obtained as a fixation ratio. The image density was measured employing a Macbeth Reflection Densitometer RD-918. Fixing temperature, which resulted in the fixation ratio of at least 95 percent, was designated as a fixability temperature.

Herein, evaluation criteria are as follows:

A: excellent: fixability temperature was at least 100° C.

B: good: fixability temperature was at least 70° C.

C: commercially viable: fixability temperature was at least 40° C.

D: commercially unviable: fixability temperature was less than 40° C.

<Offsetting Resistance>

After continuously carrying out printing onto 1,000 A4 transfer paper sheets, a white paper sheet was printed. Subsequently, staining on said white paper sheet, as well as toner staining on the surface of the fixing member, was visually observed.

Further, employed as transfer paper sheets were 200 g/m$^2$ fine-quality thick paper sheets, and a 0.3 mm wide and 150 mm long line image was formed parallel to the paper in the downstream direction (the heating roller peripheral direction).

A: neither image offsetting nor toner staining on the heating roller was noticed B: it was impossible to notice image offsetting, but toner staining on the heating roller was noticed C: it was possible to notice image offsetting Table 10 shows the results.

TABLE 10

| | Toner Storage Stability | Fixability Temperature Range | Offsetting Resistance | Maximum Density $D_L$ at Low Temperature and Low Humidity | Image Density $D_H$ at High Temperature and High Humidity | $D_H - D_L$ |
|---|---|---|---|---|---|---|
| Example 21 | A | A | A | 1.44 | 1.47 | 0.03 |
| Example 22 | A | B | A | 1.43 | 1.46 | 0.03 |
| Example 23 | B | A | A | 1.42 | 1.46 | 0.04 |
| Example 24 | A | B | B | 1.43 | 1.47 | 0.04 |
| Example 25 | B | B | B | 1.41 | 1.47 | 0.06 |
| Example 26 | B | B | B | 1.42 | 1.46 | 0.04 |
| Comparative Example 21 | C | D | D | 1.20 | 1.46 | 0.26 |
| Comparative Example 22 | B | D | D | 1.28 | 1.49 | 0.21 |
| Comparative Example 23 | C | D | D | 1.26 | 1.40 | 0.14 |
| Comparative Example 24 | D | C | D | 1.27 | 1.47 | 0.20 |
| Comparative Example 25 | D | C | D | 1.26 | 1.46 | 0.20 |

As can clearly be seen from Table 5, all the characteristics of Examples 21 through 26 were excellent, while at least one of the characteristics of Comparative Examples 21 through 25 caused problems.

The present invention is capable of providing an electrostatic latent image developing toner, which exhibits excellent storage stability, minimizes variation of electrostatic charge amount due to high humidity, resulting in consistent production of high quality images, while minimizing the variation of developed density, and a developer as well as an image forming method using the same.

What is claimed is:

1. A toner for forming an electrophotographic image comprising a toner particle comprising a resin and a colorant, wherein the toner particle comprises at least two inorganic salts including an inorganic salt comprising a positive ion having a first valence and an inorganic salt comprising a positive ion having a second valence different from the first valence, a total amount of the inorganic salt having the first valence is greatest among the inorganic salts in the toner particle, and a total amount of the inorganic salt having the second valence is second greatest among the inorganic salts in the toner particle, with the formulas of;

$$2.0 \geqq a \geqq 0.1$$

$$1.0 \geqq b \geqq 0.01$$

$$7.5 \geqq a/b \geqq 1.1$$

wherein "a" is percent by weight of the first inorganic salt based on the total weight of the toner and "b" percent by weight of the second inorganic salt based on the total weight of the toner, and "a" and "b" is value in terms of anhydride.

2. The toner of claim 1, wherein "a" and "b" satisfy the formulas of;

$$1.5 \geqq a \geqq 0.4$$

$$0.8 \geqq b \geqq 0.06$$

$$7.5 \geqq a/b \geqq 1.1.$$

3. The toner of claim 1, wherein resin comprises polymerizable monomer having a carboxyl group in an amount of 1.0 to 12.0 percent, being the monomer weight ratio, as a recurring unit.

4. The toner of claim 3, wherein resin comprises polymerizable monomer having a carboxyl group in an amount of 3.0 to 12.0 percent, being the monomer weight ratio, as a recurring unit.

5. The toner of claim 4, wherein resin comprises polymerizable monomer having a carboxyl group in an amount of 6 to 10 percent, being the monomer weight ratio, as a recurring unit.

6. The toner of claim 1, wherein glass transition point of said toner is from 50 to 65° C. during the first temperature increasing process and from 40 to 55° C. during the second temperature increasing process by means of differential scanning calorimeter (DSC).

7. The toner of claim 1, wherein difference of between the first valence and the second valence is from 1 to 2.

8. The toner of claim 1, wherein both of the first and second inorganic salt are chloride.

9. The toner of claim 1, wherein the first valence is higher than the second valence.

10. The toner of claim 9, wherein the first valence is from 2 to 4.

11. The toner of claim 9, wherein the first valence is 2.

12. The toner of claim 1, wherein the inorganic salt are salt of metal selected from the group consisting of sodium, potassium, lithium, magnesium, calcium, zinc, copper, aluminum, iron, titanium and tin.

13. The toner of claim 12, wherein the first and the second inorganic salt are salt of metal selected from the group consisting of sodium chloride, potassium chloride, lithium chloride, magnesium chloride, calcium chloride, zinc chloride, copper sulfate, magnesium sulfate, and manganese sulfate, aluminum chloride, aluminum hydroxide, aluminum sulfate, iron chloride, titanyl sulfate and tin tetrachloride.

14. The toner of claim 13, wherein the inorganic salt comprising a positive ion having a first valence is magnesium chloride and the inorganic salt comprising a positive ion having a second valence is sodium chloride.

15. The toner of claim 1, wherein the toner particle is prepared by aggregating resin particles and fusing those in a water based medium.

16. A production method of toner of claim 1, in which the toner particle is formed through salting-out/aggregating resinous particles in a dispersion comprising resinous particles, wherein the production method comprises (1) adding a salting-out agent which initiates growth of aggregated particle to the dispersion, (2) adding a salting-out termination agent to the dispersion when aggregated particles has predetermined size, (3) separating aggregated particles from said dispersion, and (4) drying the aggregated particles, in that order.

17. The method of claim 16, wherein valence of positive ion of the salting-out termination salt is lower than valence of positive ion of the salting-out agent.

18. The method of claim 16, wherein the predetermined size is from 2 to 9 $\mu$m in terms of volume average particle diameter.

19. The method of claim 16, wherein the dispersion contains an anionic surfactant.

20. The method of claim 16, wherein the salting-out termination salt is a monovalent inorganic salt and the salting-out agent is a divalent inorganic salt.

21. The method of claim 16, wherein the salting-out termination salt is a monovalent or divalent inorganic salt and the salting-out agent is a trivalent inorganic salt.

22. The method of claim 16, wherein salting-out termination agent is added when the particle diameter during the salting-out/aggregation process reaches 80 to 120 percent of the volume average diameter of the particles after the drying.

* * * * *